US011000173B2

(12) United States Patent
Ting

(10) Patent No.: US 11,000,173 B2
(45) Date of Patent: May 11, 2021

(54) SYNCHRONOUSLY FOLDABLE AND EXPANDABLE FLAT MOP

(71) Applicant: Ming-Che Ting, Taoyuan (TW)

(72) Inventor: Ming-Che Ting, Taoyuan (TW)

( * ) Notice: Subject to any disclaimer, the term of this patent is extended or adjusted under 35 U.S.C. 154(b) by 169 days.

(21) Appl. No.: 16/450,809

(22) Filed: Jun. 24, 2019

(65) Prior Publication Data

US 2019/0387949 A1 Dec. 26, 2019

(30) Foreign Application Priority Data

Jun. 25, 2018 (TW) ..... 107121635

(51) Int. Cl.
*A47L 13/258* (2006.01)

(52) U.S. Cl.
CPC ..... *A47L 13/258* (2013.01)

(58) Field of Classification Search
CPC ..... A47L 13/258
See application file for complete search history.

(56) References Cited

U.S. PATENT DOCUMENTS 5,272,783 A * 12/1993 Richardson ..... A47L 13/258 15/119.2
9,468,354 B2 10/2016 Salmon
9,943,207 B1 4/2018 Patterson
2015/0351604 A1* 12/2015 Li ..... A47L 13/38 15/231

FOREIGN PATENT DOCUMENTS

TW 201406339 A 2/2014
TW M565545 U 8/2018
WO WO 2015/049009 A1 * 4/2015

* cited by examiner

*Primary Examiner* — Randall E Chin
(74) *Attorney, Agent, or Firm* — Maschoff Brennan

(57) ABSTRACT

The invention discloses a folding flat mop having a mop-holding rod, two wing plates, a synchronous-folding-expanding connecting body, a synchronous-folding-expanding element, and a rotating sleeve connector. Each wing plate has a press-against body having an upper protrusion and a side protrusion, and a cleaning member is mounted on a bottom surface of each wing plate. The synchronous-folding-expanding connecting body has a shaft portion and two wing-plate-connecting portions respectively pivotally connected to the two wing plates. The synchronous-folding-expanding element is installed in a hole of the shaft portion, and each end of the synchronous-folding-expanding element is pivotally connected to or is gear engaged with each wing plate. The rotating sleeve connector has a sleeve portion covering an outer circumferential surface of the shaft portion and an attaching portion protruding upward from the sleeve portion to connect to the mop-holding rod.

13 Claims, 25 Drawing Sheets

SYNCHRONOUSLY FOLDABLE AND EXPANDABLE FLAT MOP

FIELD OF THE INVENTION

The present invention relates to a synchronously foldable and synchronously expandable synchronously foldable and expandable flat mop, whose two wing plates are lockable when two wing plates are folded, and whose bottom surfaces of the two wing plates are locked in a horizontal plane when the two wing plates are expanded.

BACKGROUND OF THE INVENTION

A mop head of a conventional foldable flat mop is with structure as follows. A wing plate is connected to each side of two sides of a connector. A mop head is installed on a bottom side of each wing plate. A mop-holding rod connects to the connector. When two wing plates are expanded outward with respective to the connector, the foldable flat mop is in an expanded situation for cleaning operation. When the two wing plates are folded inward, the foldable flat mop occupies less space for mop head cleaning and storing.

However, the conventional foldable flat mops are without function for firmly locking the two wing plates when the two wing plates are expanded outward in a horizontal plane for cleaning operation. In detail, when the two wing plates are expanded outward, the unnecessary pivoting may happen in the jointing points between each wing plate and the connector in the conventional foldable flat mop to thus cause the bottom surfaces of the two wing plate to be not horizontal to each other. Thus it affects the cleaning performance. Even though a fixing spring is deliberately mounted between the wing plate and the connector, the unnecessary pivoting still exists in the joint points between the wing plate and connector because the fixing spring has its maximum loading. Moreover, when the two wing plates are folded, it also lacks a folded-locking mechanism such that it causes the two wing plates to easily sway or shake.

SUMMARY OF THE INVENTION

Therefore, an object of the present invention is to provide a synchronously foldable and expandable flat mop which is with function of synchronous-folding and synchronous-expanding. The synchronously foldable and expandable flat mop is lockable when it is folded, and its bottom surfaces of the two wing plates are locked in a horizontal plane with each other such that it prevents, caused by the user's operating force, from the shaking of the two wing plates resulting in the non-horizontal bottom surfaces during cleaning operation.

In order to achieve the above, the present invention provides a synchronously foldable and expandable flat mop, having: a mop-holding rod; two wing plates, each wing plate having a press-against body, the press-against body being provided with an upper protruding portion and a side protruding portion, the upper protruding portion being provided with a top surface and a side press-against surface, the side protruding portion being provided with an upper press-against surface and/or a lower press-against surface, a height of the top surface is higher than a height of the upper press-against surface, and a cleaning member being provided on a bottom surface of each wing plate; a synchronous-folding-expanding connecting body having a shaft portion and two wing-plate-connecting portions, a receiving accommodation being provided in each end of the shaft portion, each wing-plate-connecting portion being extended from each end of the two ends of the shaft portion such that each wing-plate-connecting portion is pivotally connected to each wing plate; a synchronous-folding-expanding element being installed in a hole of the shaft portion, each end of the synchronous-folding-expanding element being pivotally connected to or being gear engaged with each one of two wing plates such that the two wing plates are synchronously to be folded or expanded in relation to the synchronous-folding-expanding element; and a rotating sleeve connector including a sleeve portion and an attaching portion, each end of two ends of the sleeve portion being provided with an upper locking recess and a lower locking recess, the sleeve portion being provided to cover an outer circumferential surface of the shaft portion of the synchronous-folding-expanding connector to rotate in relation to the shaft portion, the attaching portion being protrudes upward from the sleeve portion to connect to the mop-holding rod, wherein when the two wing plates are to be folded, the two wing plates are synchronously driven by the synchronous-folding-expanding element such that the two wing plates are synchronous to be folded with each other by taking each joint point between the wing plate and the synchronous-folding-expanding connecting body as a rotating axle to thus enable the upper protruding portion of the wing plate to fasten in the upper locking recess of the sleeve portion to firmly lock the wing plate to the upper locking recess, wherein when the two wing plates are to be expanded, the two wing plates are synchronously driven by the synchronous-folding-expanding element such that the two wing plates are synchronous expanded with each other by taking each joint point between the wing plate and the synchronous-folding-expanding connecting body as a rotating axle to enable the side protruding portion of the wing plate to pass through the lower locking recess of the sleeve portion until the side protruding portion is accommodated within the receiving accommodation, and then the rotating sleeve connector is rotated with respective to the shaft portion to enable the upper press-against surface and/or the lower press-against surface to press against a press-against area of an inner surface of the sleeve portion.

In one embodiment of the synchronously foldable and expandable flat mop of the present invention, when the upper press-against surface of the side protruding portion and/or the lower press-against surface of the side protruding portion is moved to the press-against area, and the rotating sleeve connector rotates with respective to the shaft portion, an outer surface of the sleeve portion presses against the side press-against surface of the upper protruding portion.

In one embodiment of the synchronously foldable and expandable flat mop of the present invention, when the synchronous-folding-expanding element is pivotally connected with the two wing plates, the synchronous-folding-expanding element is a crossbar.

In one embodiment of the synchronously foldable and expandable flat mop of the present invention, when the synchronous-folding-expanding element is engaged with the two wing plates by gear, the synchronous-folding-expanding element is two gear-engaging members which are gear-engaged with each other, and a surface of each wing plate is provided with a gear-corresponding-engaging member.

In one embodiment of the synchronously foldable and expandable flat mop of the present invention, each wing plate is provided with two pivot-attaching portions between which the press-against body is formed, and the wing-plate-connecting portion is provided with two pivot blocks between which an attaching groove is formed such that each pivot block is pivotally mounted within the pivot-attaching portion of each wing plate.

In one embodiment of the synchronously foldable and expandable flat mop of the present invention, the receiving accommodations are located outside of two ends of the shaft portion.

In one embodiment of the synchronously foldable and expandable flat mop of the present invention, the mop-holding rod pivotally connects to the attaching portion.

In one embodiment of the synchronously foldable and expandable flat mop of the present invention, the sleeve portion is provided with a housing hole and a slot such that the shaft portion moves through the slot to be in the housing hole such that the sleeve portion covers the outer circumferential surface of the shaft portion.

In one embodiment of the synchronously foldable and expandable flat mop of the present invention, the sleeve portion is provided with a housing hole but not with a slot such that the shaft portion moves through the housing hole to enable the sleeve portion to cover the outer circumferential surface of the shaft portion.

In one embodiment of the synchronously foldable and expandable flat mop of the present invention, the attaching portion of the rotating sleeve connector is provided with a locking portion which presses against a locking corresponding portion disposed at an end of the mop-holding rod, the locking corresponding portion includes a spring and a positioning ball such that a spring force from the spring is exerted to the positioning ball to press against the locking portion of the attaching portion.

In one embodiment of the synchronously foldable and expandable flat mop of the present invention, each wing plate is provided with a wing-plate-positioning set which is mounted on a side wall surface of the pivot-attaching portion of the wing plate, the wing-plate-positioning set presses against a fold-positioning portion of the wing-plate-connecting portion of the synchronous-folding-expanding connecting body or an expand-positioning portion of the wing-plate-connecting portion of the synchronous-folding-expanding connecting body such that when the two wing plates are synchronously expanded, the wing-plate-positioning set presses against the expand-positioning portion of the wing-plate-connecting portion, and when the two wing plates are synchronously to be folded, the wing-plate-positioning set presses against the fold-positioning portion of the wing-plate-connecting portion.

In one embodiment of the synchronously foldable and expandable flat mop of the present invention, the wing-plate-positioning set is provided with an elastic member and a positioning member, the positioning member is disposed on an end of the elastic member and is exposed from the side wall surface of the pivot-attaching portion to press against the fold-positioning portion or the expand-positioning portion, wherein the fold-positioning portion and the expand-positioning portion are recesses which are formed in a surface of the wing-plate-connecting portion.

In one embodiment of the synchronously foldable and expandable flat mop of the present invention, the wing plate includes a plate base and a plate body, a bottom surface of the plate base is provided with a slide-connecting portion, the cleaning member is mounted on a bottom side of the plate body, and the plate body is provided with a slide-engaging portion which corresponds to the slide-connecting portion, the slide-engaging portion slidably connects to or slidably removes from the slide-connecting portion of the plate base in a longitudinal direction of the plate base.

The synchronously foldable and expandable flat mop has the technical effects as bellowed. When the two wing plates are folded, the upper locking recesses of the rotating sleeve connector are able to lock the two wing plates to enable the two wing plates to be locked in a folded state. While the two wing plates are operated to expand, the rotating sleeve connector is rotated to press against the side press-against surfaces, the upper press-against surfaces, and the lower press-against surfaces of the two wing plates such that the two wing plates are locked in such a manner that the bottom surfaces of the two wing plates are fastened in a horizontal plane. Moreover, when the side press-against surfaces are pressed against with the inner surface of the rotating sleeve connector, the two wing plates cannot be folded. Furthermore, the wing plate are formed by the plate base and the plate body which slidably connects to the plate base such that the plate body can be replaced as required to achieve replacement of the plate body.

BRIEF DESCRIPTION OF THE DRAWINGS

FIG. 1(*b*) shows a perspective view of the synchronously foldable and expandable flat mop in an expanded state according to first embodiment of the present invention;

FIG. 1(*c*) shows a perspective view of the synchronously foldable and expandable flat mop in a folded state according to first embodiment of the present invention;

FIG. 2(*b*) shows a perspective view of the synchronously foldable and expandable flat mop according to second embodiment of the present invention;

FIG. 2(*c*) shows a perspective view of a synchronously foldable and expandable flat mop in a folded state according to second embodiment of the present invention;

FIG. 3(*b*) shows a perspective view of the synchronously foldable and expandable flat mop shown expanded according to the embodiment of the present invention;

FIG. 3(*c*) shows a bottom view of the synchronously foldable and expandable flat mop shown expanded according to the embodiment of the present invention;

FIG. 3(*d*) shows a perspective view of the synchronously foldable and expandable flat mop shown synchronous-expanded according to the embodiment of the present invention;

FIG. 3(*e*) shows a side view of the synchronously foldable and expandable flat mop shown expanded according to the embodiment of the present invention;

FIG. 3(*f*) shows the other side view of the synchronously foldable and expandable flat mop shown expanded according to the embodiment of the present invention;

FIG. 4(*b*) shows a bottom view of the synchronously foldable and expandable flat mop shown expanded and locked according to the embodiment of the present invention;

FIG. 4(*c*) shows a bottom view of the synchronously foldable and expandable flat mop shown expanded and locked according to the embodiment of the present invention;

FIG. 5(*b*) shows the other perspective view of the synchronously foldable and expandable flat mop shown expanded and locked according to the embodiment of the present invention;

FIG. 6(*b*) shows a side view of the synchronously foldable and expandable flat mop according to second embodiment of the present invention;

FIG. 7(*b*) shows a partial perspective view of the synchronously foldable and expandable flat mop according to first embodiment of the present invention;

FIG. 8(*b*) shows a partial perspective view of the synchronously foldable and expandable flat mop according to second embodiment of the present invention;

FIG. 9(*b*) shows a cross sectional side view of the synchronously foldable and expandable flat mop shown the wing plate provided with the wing-plate-positioning set according to the embodiment of the present invention.

DETAILED DESCRIPTION OF THE PREFERRED EMBODIMENTS

Figure 1A:
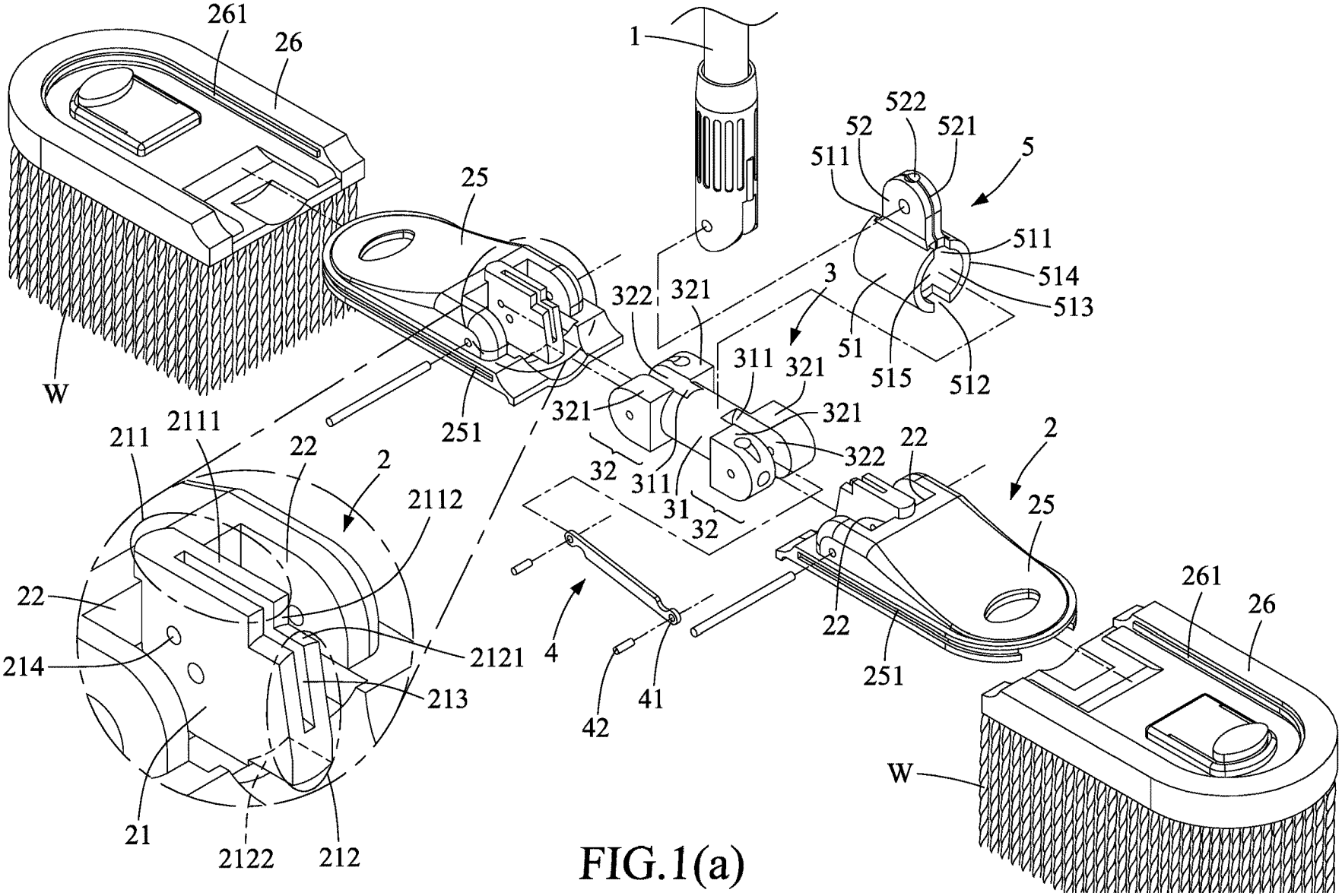
FIG. 1(*a*) shows an exploded perspective view of a synchronously foldable and expandable flat mop according to first embodiment of the present invention.
Figure 1B:
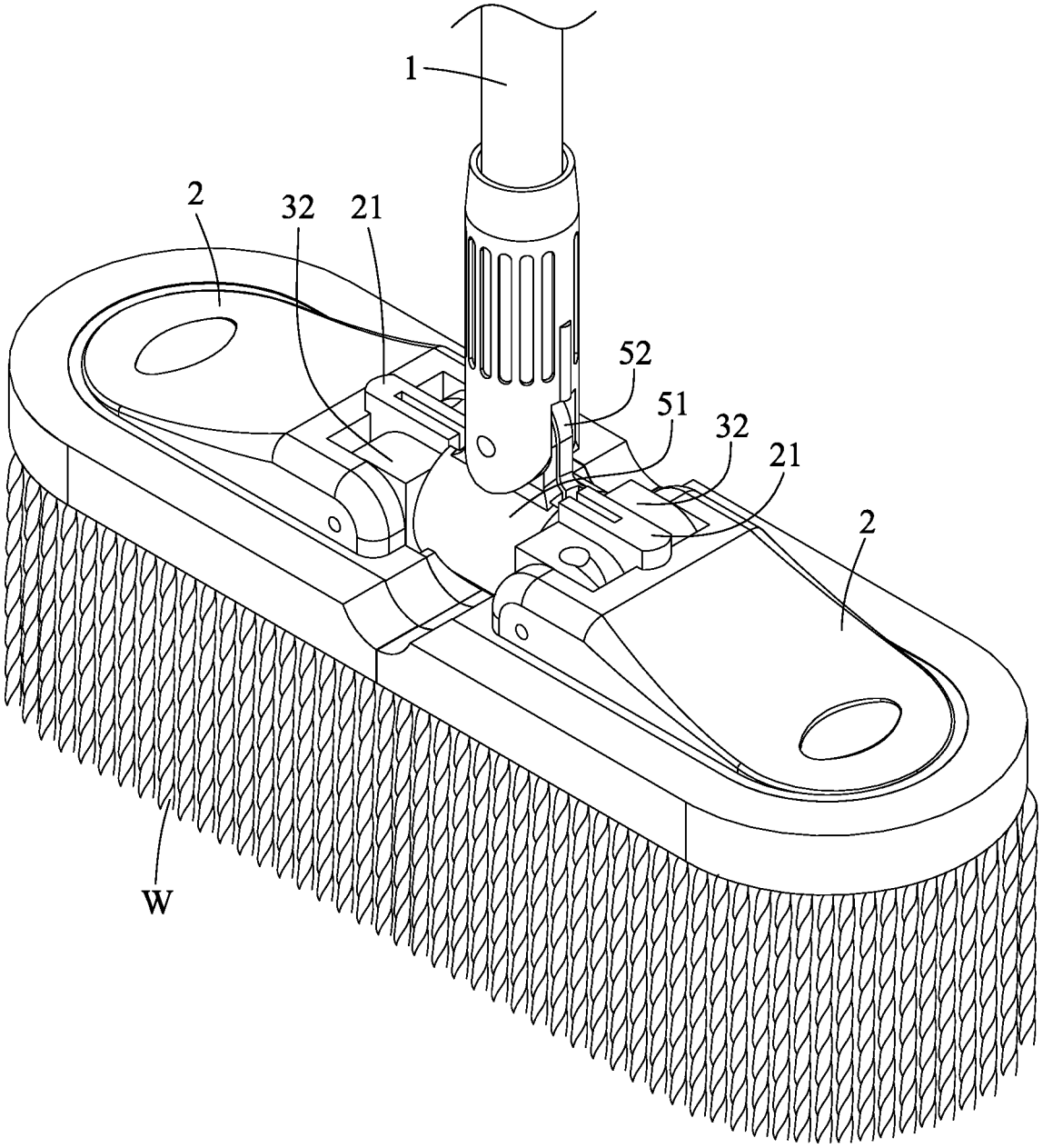
Figure 1C:
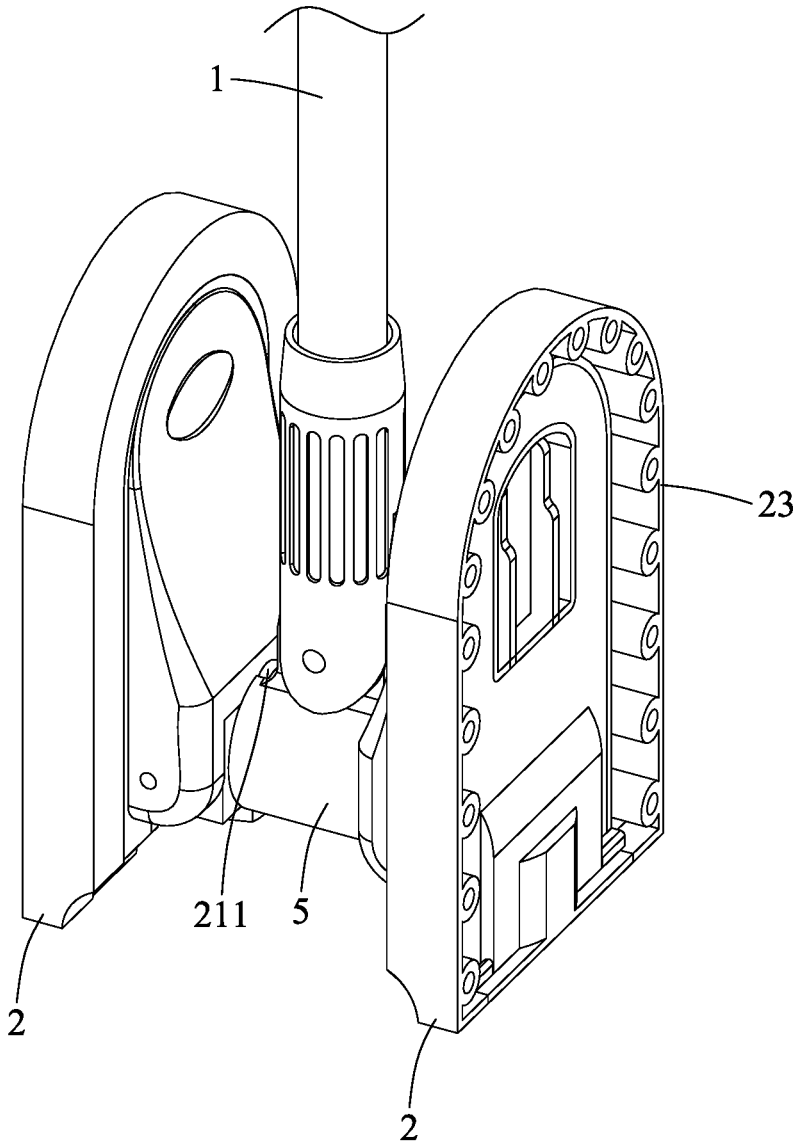

With reference to FIGS. 1(*a*) to 9(*b*), the embodiments of the present invention are described. The embodiment does not limit the scope of the present invention but is only for explaining the present invention.

First of all, first embodiment of the synchronous synchronously foldable and expandable flat mop of the present invention, which uses a crossbar as a synchronous-folding-expanding element, is described. FIGS. 1(*a*), 1(*b*), 1(*c*), 6(*a*), 7(*a*) and 7(*b*) show that in first embodiment, the synchronously foldable and expandable flat mop of the present invention comprises: a mop-holding rod 1, two wing plates 2, a synchronous-folding-expanding connecting body 3, a synchronous-folding-expanding element 4, and a rotating sleeve connector 5. The two wing plates 2 of the synchronously foldable and expandable flat mop are pivotally connected to the synchronous-folding-expanding connecting body 3. The synchronously foldable and expandable flat mop uses the synchronous-folding-expanding element 4, which is the crossbar, to link the two wing plates 2 such that the two wing plates 2 synchronously rotate with respect to the synchronous-folding-expanding connecting body 3 in a manner that the two wing plates 2 synchronously expanded and synchronously folded. In first embodiment, FIG. 1(*b*) shows that the two wing plates 2 are expanded. FIG. 1(*c*) shows that the two wing plates 2 are folded.

In detail, in FIG. 1(*a*) of the first embodiment, each wing plate 2 comprises a press-against body 21. The press-against body 21 comprises an insertion groove 213 and a through hole 214. Each end of the crossbar, i.e., the synchronous-folding-expanding element 4, comprises a linking hole 41. The synchronous-folding-expanding connecting body 3 comprises a shaft portion 31 and two wing-plate-connecting portions 32 extending from the shaft portion 31. Each end of the shaft portion 31 comprises a receiving accommodation 311. The two wing-plate-connecting portions 32 are in two ends of the shaft portion 31 respectively. Each wing-plate-connecting portion 32 comprises two pivot blocks 321. An attaching groove 322 is formed between the two pivot blocks 321. The pivot block 321 is pivotally mounted within pivot-attaching portion 22 of the wing plate 2. The shaft portion 31 comprises an inner hollow portion, not shown in drawings. The crossbar, i.e., the synchronous-folding-expanding element 4, inserts within the inner hollow portion of the shaft portion 31. Each end of the crossbar, i.e., the synchronous-folding-expanding element 4, inserts within the insertion groove 213 of the wing plate 2 such that the linking holes 41 located in two ends of the crossbar are pivotally connected with the through holes 214 of the wing plates 2 by pins 42. Therefore, the crossbar synchronously drives the two wing plates 2 in such a manner that the two wing plates 2 synchronously rotate with respect to the synchronous-folding-expanding connecting body 3 to enable the two wing plates 2 to synchronously expand and synchronously fold with each other.

Each wing plate 2 comprises a press-against body 21. The press-against body 21 comprises an upper protruding portion 211 and a side protruding portion 212. The upper protruding portion 211 comprises a top surface 2111 and a side press-against surface 2112. The side protruding portion 212 comprises an upper press-against surface 2121 and a lower press-against surface 2122, as shown in FIG. 3(*c*). A height of the top surface 2111 is higher than a height of the upper press-against surface 2121, and a cleaning member W is provided on a bottom surface 23 of each wing plate 2.

Figure 2A:
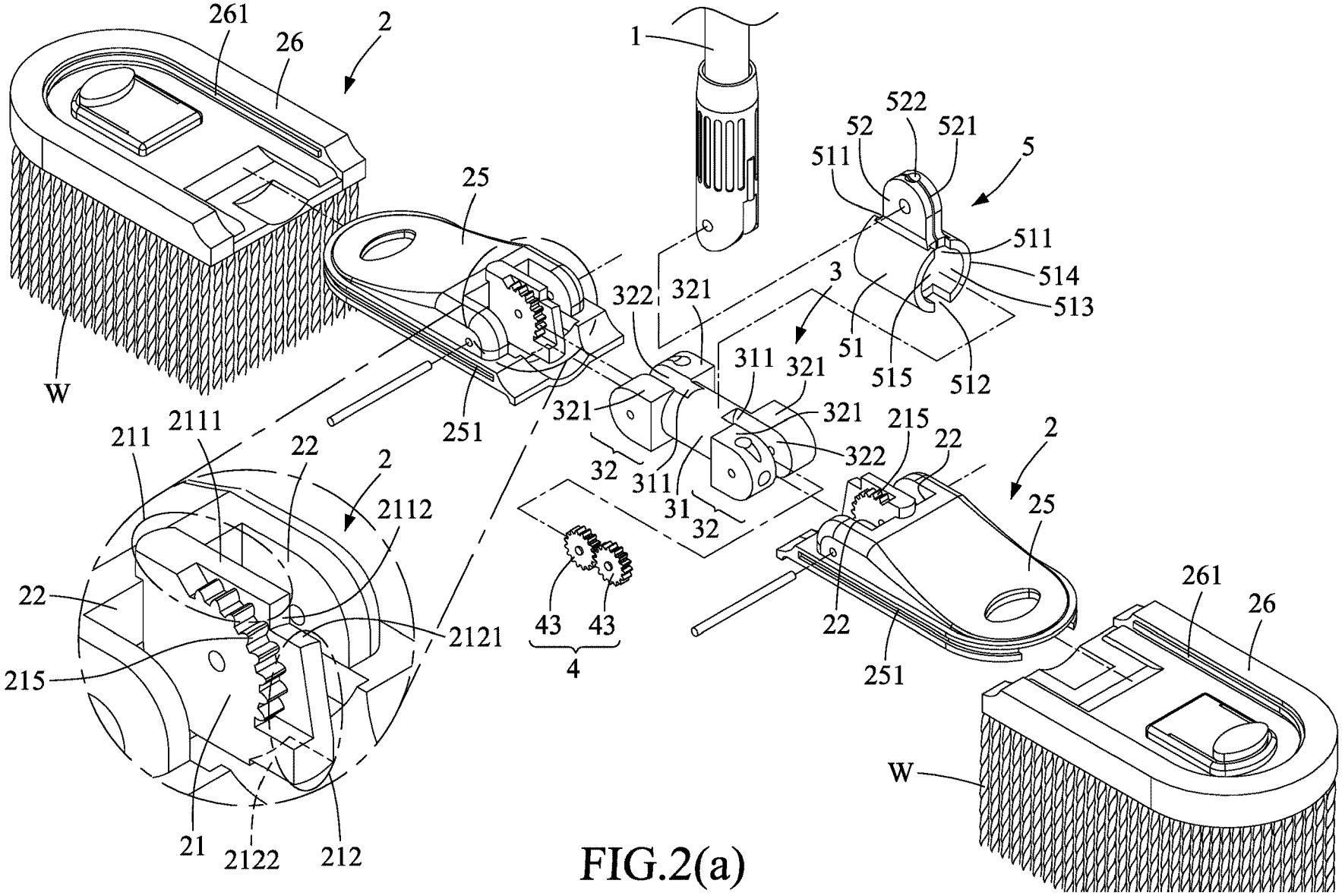
FIG. 2(*a*) shows an exploded perspective view of a synchronously foldable and expandable flat mop according to second embodiment of the present invention.
Figure 2B:
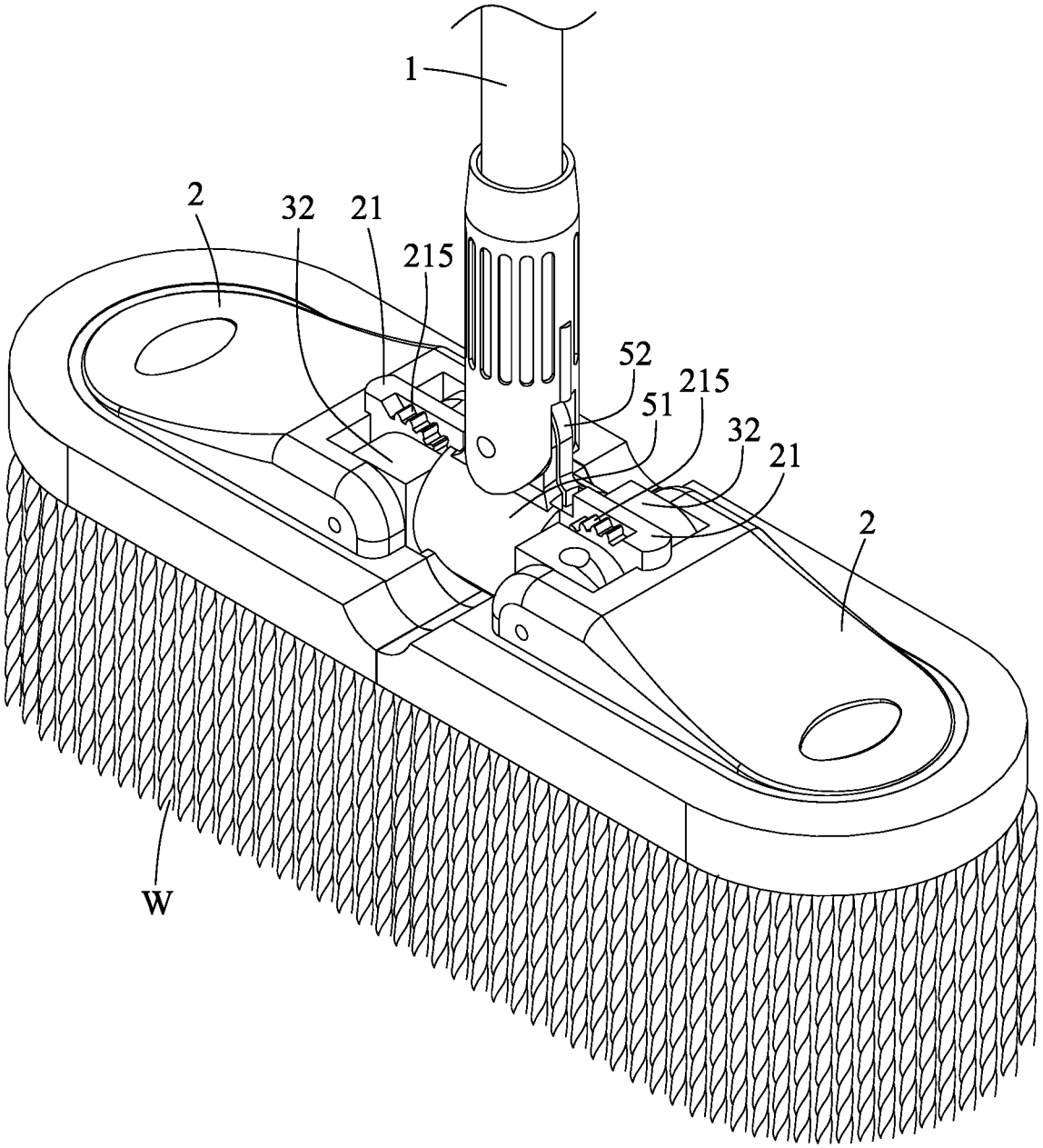
Figure 2C:
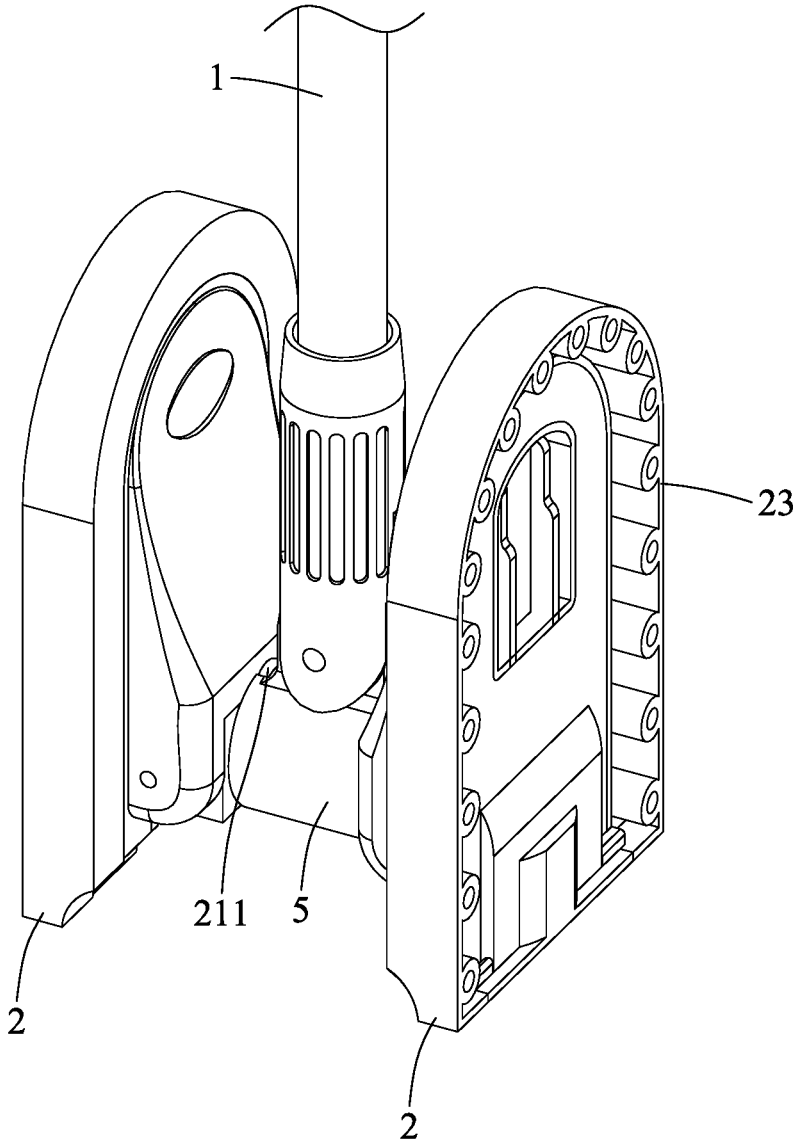
Figure 3A:
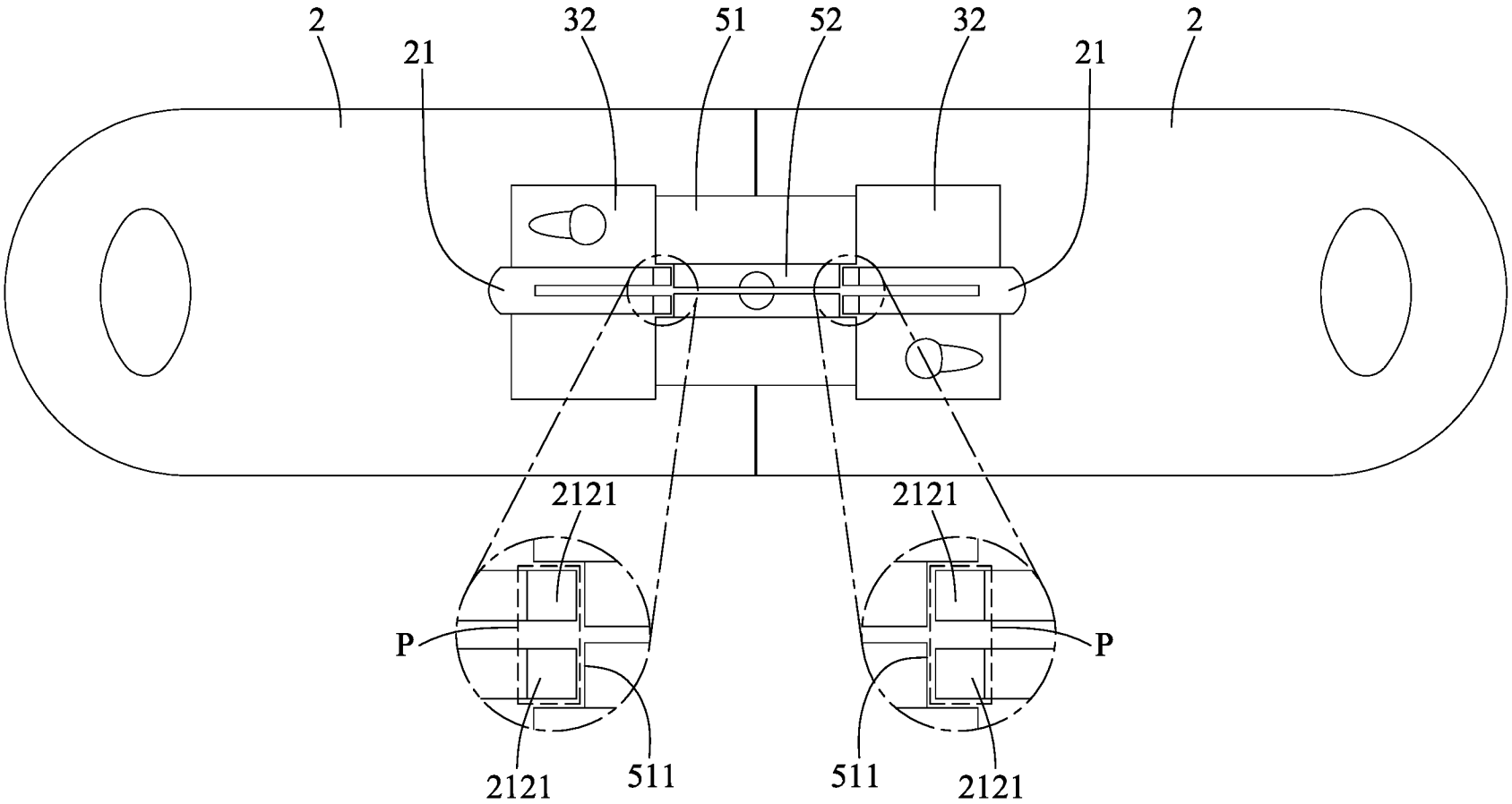
FIG. 3(*a*) shows a top view of the synchronously foldable and expandable flat mop shown expanded according to the embodiment of the present invention.
Figure 3B:
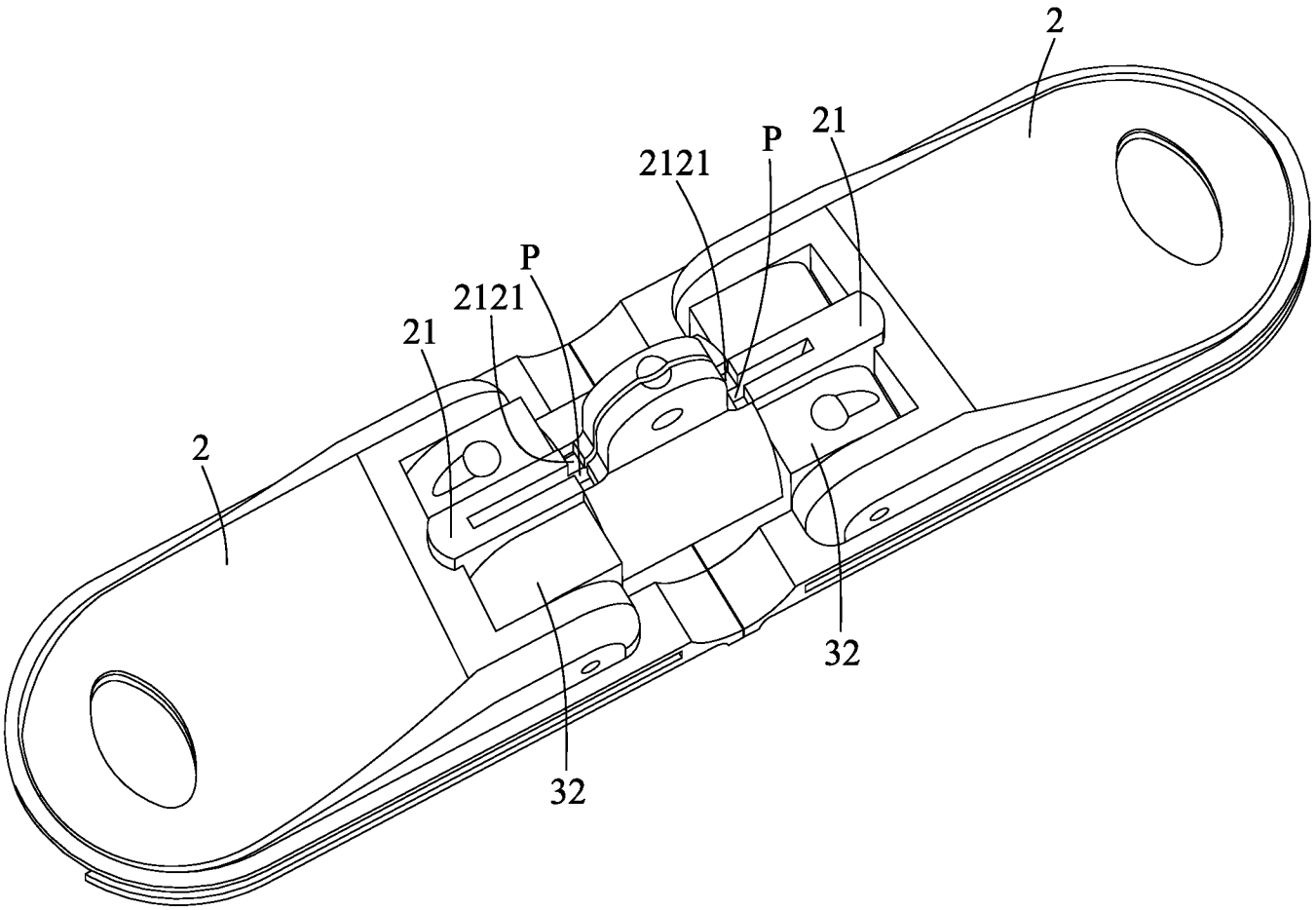
Figure 3C:
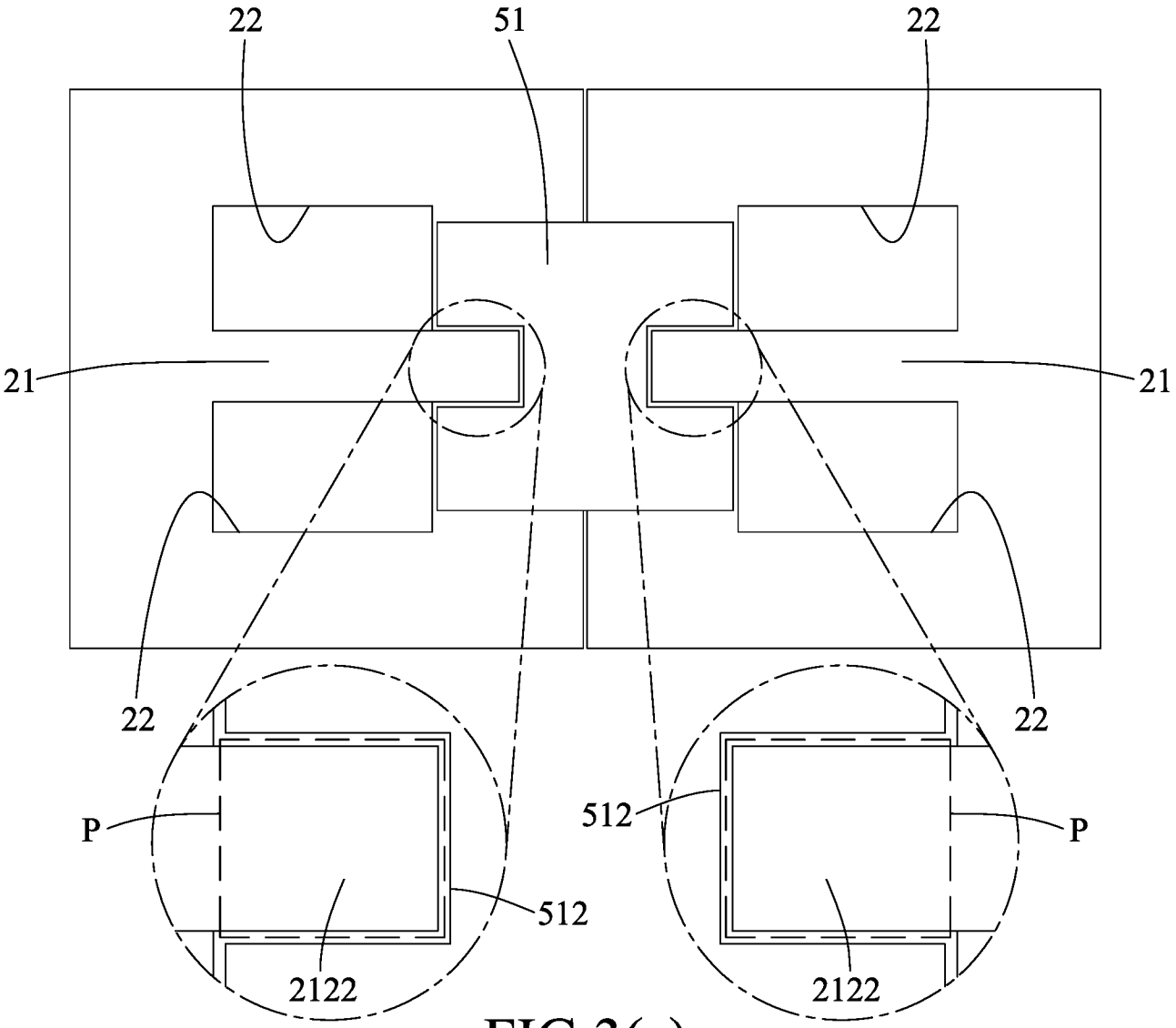
Figure 3D:
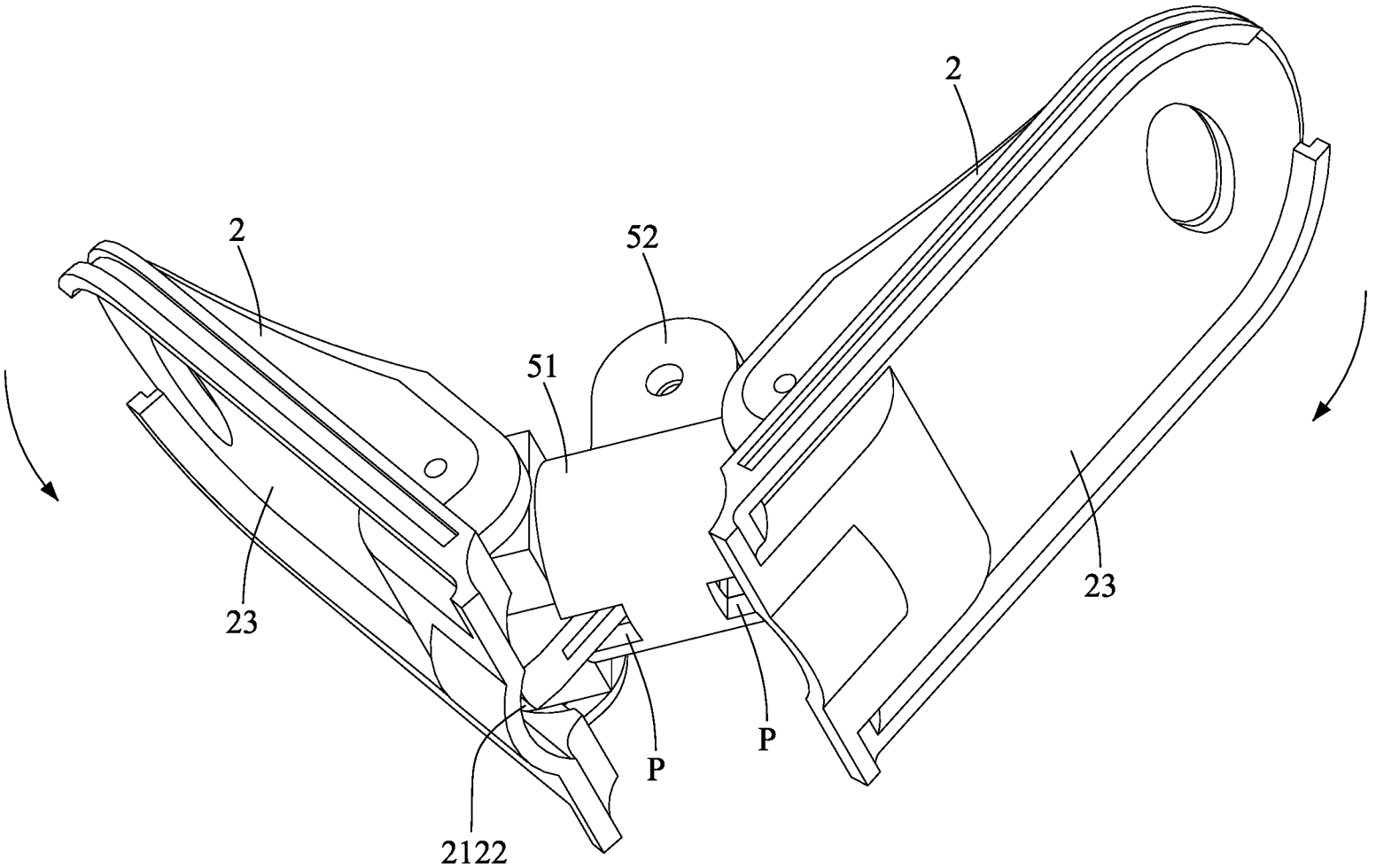
Figure 3E:
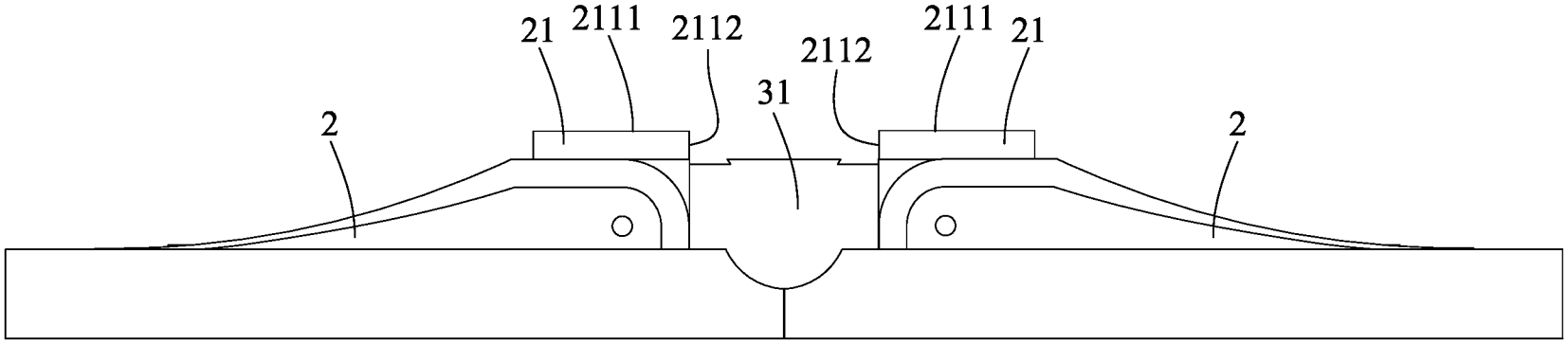
Figure 3F:
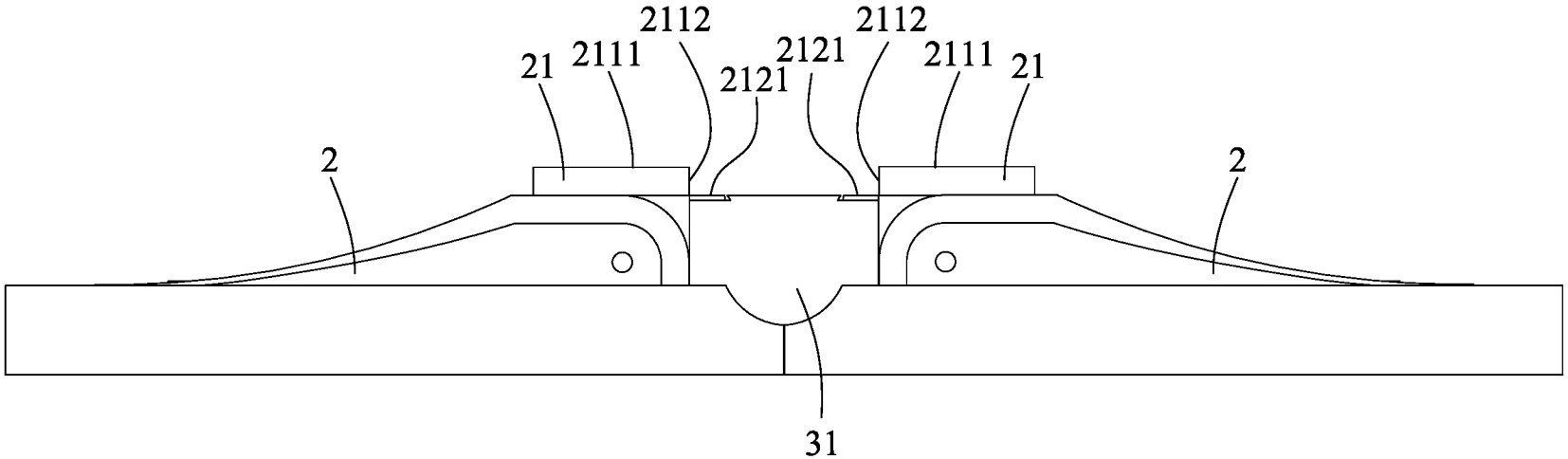

In the second embodiment of the present invention, the synchronous synchronously foldable and expandable flat mop applies a gear-engaging component as a synchronous-folding-expanding element 4, as shown in FIGS. 2(*a*), 2(*b*), 2(*c*), 6(*b*), 8(*a*), and 8(*b*). In detail, in the second embodiment of the present invention, each wing plate 2 is provided with a press-against body 21. The press-against body 21 comprises an upper protruding portion 211 and a side protruding portion 212. The upper protruding portion 211 comprises a top surface 2111 and a side press-against surface 2112. The side protruding portion 212 comprises an upper press-against surface 2121 and a lower press-against surface 2122. A height of the top surface 2111 is higher than a height of the upper press-against surface 2121, and a cleaning member W is provided on a bottom surface 23 of each wing plate 2. A side surface of the press-against body 21 is provided with a gear-corresponding-engaging member 215. The gear-engaging component, i.e., the synchronous-folding-expanding element 4, comprises two gear-engaging members 43, which are two gears engaging with each other. Moreover, in second embodiment, the synchronous-folding-expanding connecting body 3 comprises a shaft portion 31 and two wing-plate-connecting portions 32, which are the same as the first embodiment using the crossbar as the synchronous-folding-expanding element 4. Each end of the shaft portion 31 comprises a receiving accommodation 311. Each wing-plate-connecting portion 32 comprises two pivot blocks 321. An attaching groove 322 is formed between the two pivot blocks 321, and the pivot block 321 is pivotally mounted within pivot-attaching portion 22 of the wing plate 2. The shaft portion 31 comprises an inner hollow portion, not shown in drawings. The gear-engaging component inserts within the inner hollow portion of the shaft portion 31. The gear-engaging member 43 of the synchronous-folding-expanding element 4, i.e., the gear-engaging component, is exposed outside the synchronous-folding-expanding connecting body 3 to gear engage with the gear-corresponding-engaging member 215. Therefore, when the synchronous-folding-expanding element 4, i.e., the gear-engaging component, is forced by each one of the two wing plates 2 to rotate with respect to the synchronous-folding-expanding connecting body 3, the synchronous-folding-expanding element 4, i.e., the gear-engaging component, drives the other wing plate 2 such that the two wing plates 2 synchronously rotate with respect to the synchronous-folding-expanding connecting body 3 in a manner that the two wing plates 2 are operated to synchronously expand and synchronously fold with each other. In the second embodiment of the present invention, FIG. 2(*b*) shows that a gear-engaging component as a synchronous-folding-expanding element 4. FIG. 2(*b*) is a drawing that the two wing plates 2 are operated to expand. FIG. 2(*c*) also shows that a gear-engaging component as a synchronous-folding-expanding element 4. FIG. 2(*c*) shows that the two wing plates 2 are operated to fold.

As below, FIGS. 1(*a*), 2(*b*), 3(*a*) to 3(*f*), 4(*a*) to 4(*c*), and 5(*a*) to 5(*b*) show how the synchronously foldable and expandable flat mop of the present invention achieve a purpose of "locking the two folded wing plates and maintaining the bottom surfaces of the two expanding wing plates to be locked and fastened in a horizontal plane". The rotating sleeve connector 5 of the synchronously foldable and expandable flat mop comprises a sleeve portion 51 and an attaching portion 52. Each end of the sleeve portion 51 is provided with an upper locking recess 511 and a lower locking recess 512. The sleeve portion 51 is provided to cover an outer circumferential surface of the shaft portion 31 of the synchronous-folding-expanding connecting body 3 to rotate in relation to the shaft portion 31. The attaching portion 52 protrudes upward from the sleeve portion 511 to connect to the mop-holding rod 1. FIG. 3(*a*) shows a top view of the synchronously foldable and expandable flat mop while the sleeve portion 51 is in a vertical plane such that the two wing plates 2 are operated to expand. FIG. 3(*a*) shows in a simplified way with less detailed lines and with gaps among different elements in order to emphasize the relationships among the elements.

FIG. 3(*d*) shows an intermediate status view from the status of the folded state to the status of the expanded state, where the two wing plates 2 are synchronously driven by the synchronous-folding-expanding element 4, and the two wing plates 2 are operated to synchronously expand with each other by taking each joint point between the wing plate 2 and the synchronous-folding-expanding connecting body 3 as a rotating axle to enable the side protruding portion 212 of the wing plate 2 to pass through the lower locking recess 512 of the sleeve portion 511 until the side protruding portion 212 is accommodated within the receiving accommodation 311, as shown in FIGS. 3(*a*) to 3(*d*). FIG. 3(*a*), FIG. 3(*b*), FIG. 3(*c*) and FIG. 3(*e*) show that the upper press-against surface 2121 of the side protruding portion 212 and/or the lower press-against surface 2122 of the side protruding portion 212 are on the same circular surface of the shaft portion 31, as shown in FIG. 3(*e*). Alternatively, the upper press-against surface 2121 and/or the lower press-against surface 2122 is configured, when the rotating sleeve connector 5 rotates in relation to the shaft portion 31, to enable to press against an inner surface 513 of the sleeve portion 51 and enable the inner surface 513 of the sleeve portion 51 to move around the height of the upper press-against surface 2121 and/or the height of the lower press-against surface 2122. The area that the sleeve presses against the upper press-against surface 2121 of the side protruding portion 212 and/or the lower press-against surface 2122 of the side protruding portion 212 is called a press-against area P. In other words, the press-against area P is an area that the inner surface 513 of the sleeve portion 51 presses against the upper press-against surface 2121 and/or the lower press-against surface 2122, when the rotating sleeve connector 5 rotates in relation to the shaft portion 31, as shown in FIGS. 3(*a*) to 3(*c*) and 3(3) to 3(*f*).

Figure 4A:
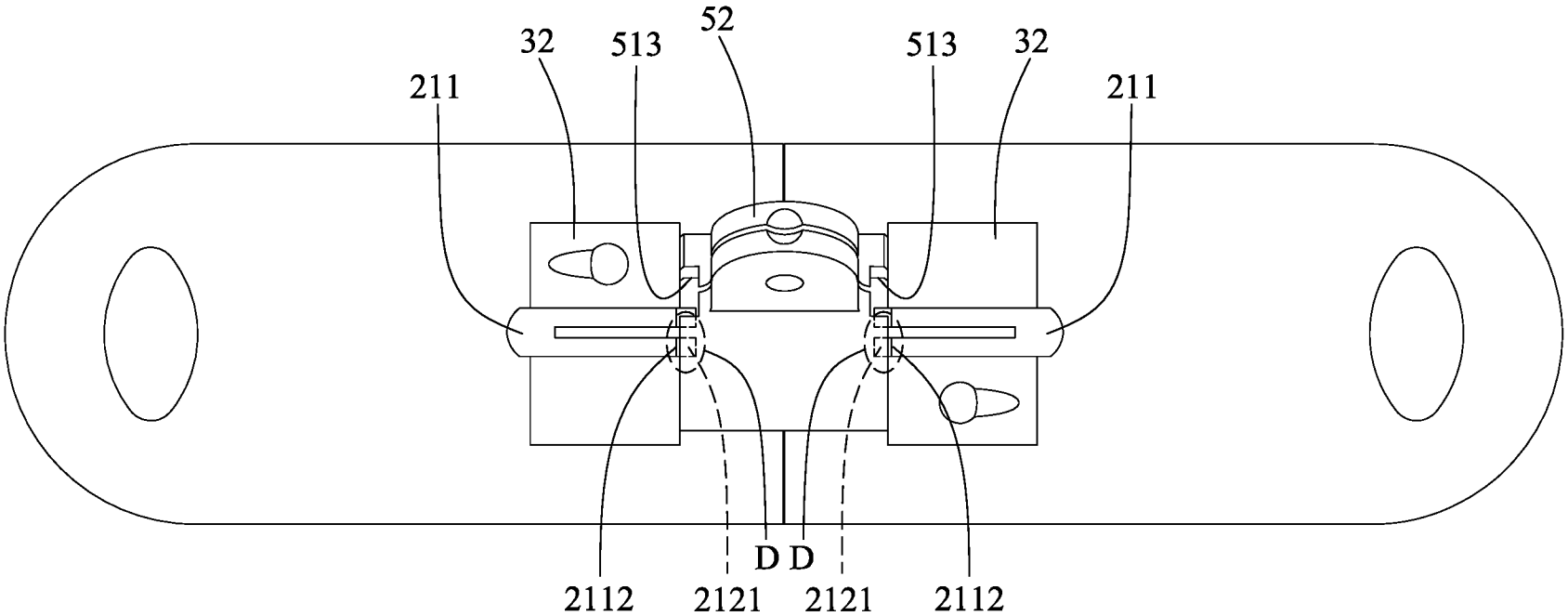
FIG. 4(*a*) shows a top view of the synchronously foldable and expandable flat mop shown expanded and locked according to the embodiment of the present invention.
Figure 4B:
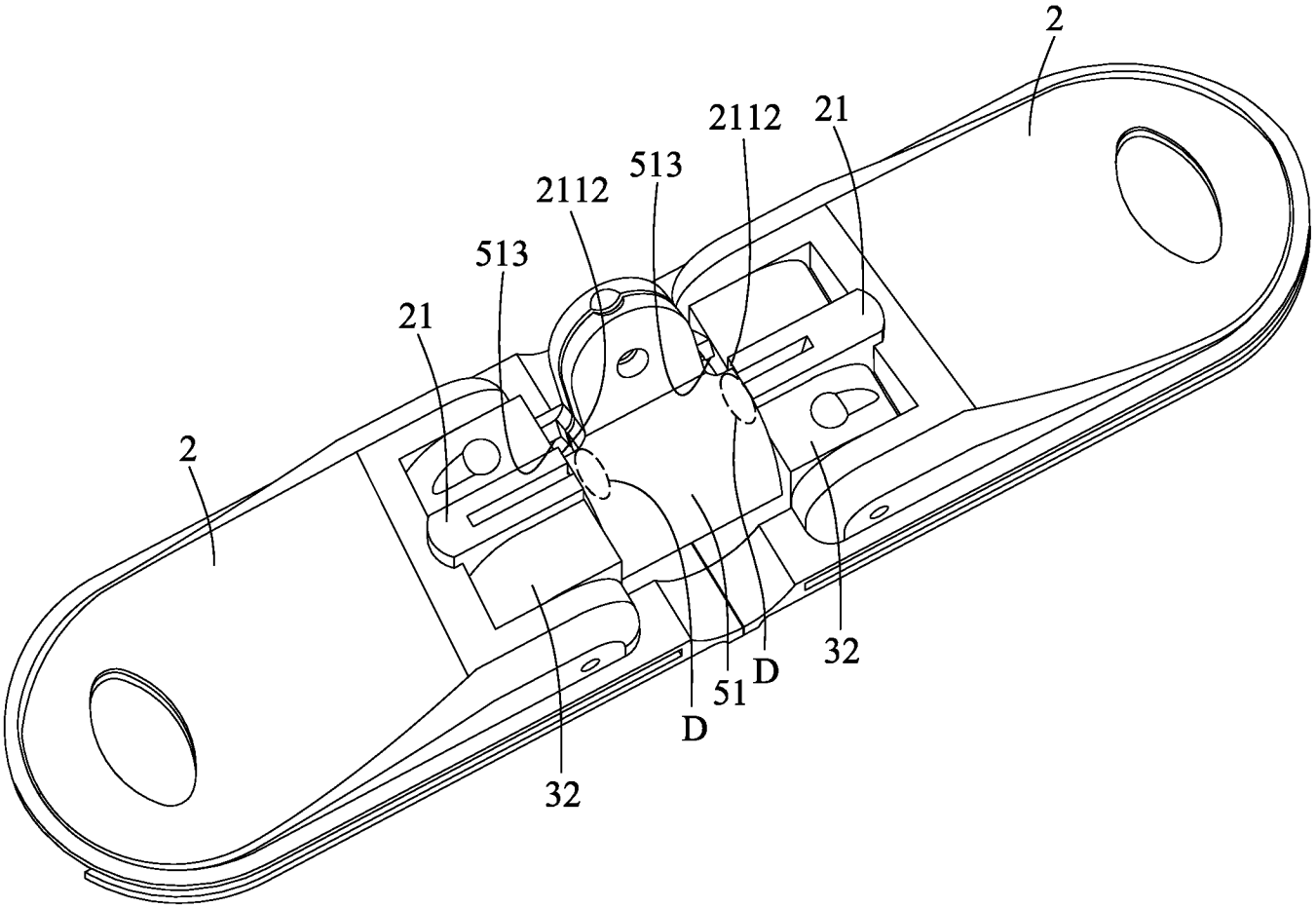
Figure 4C:
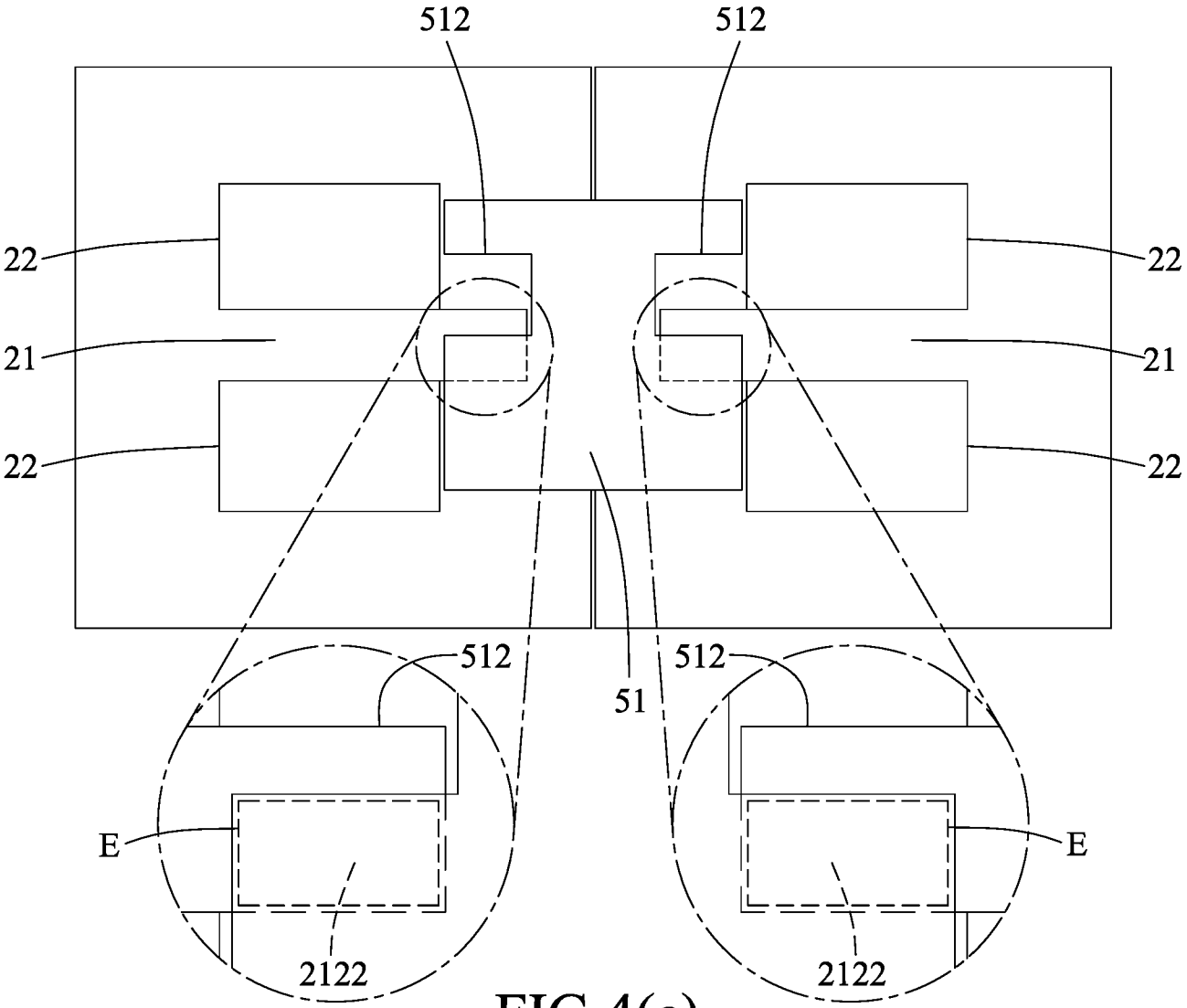
Figure 5A:
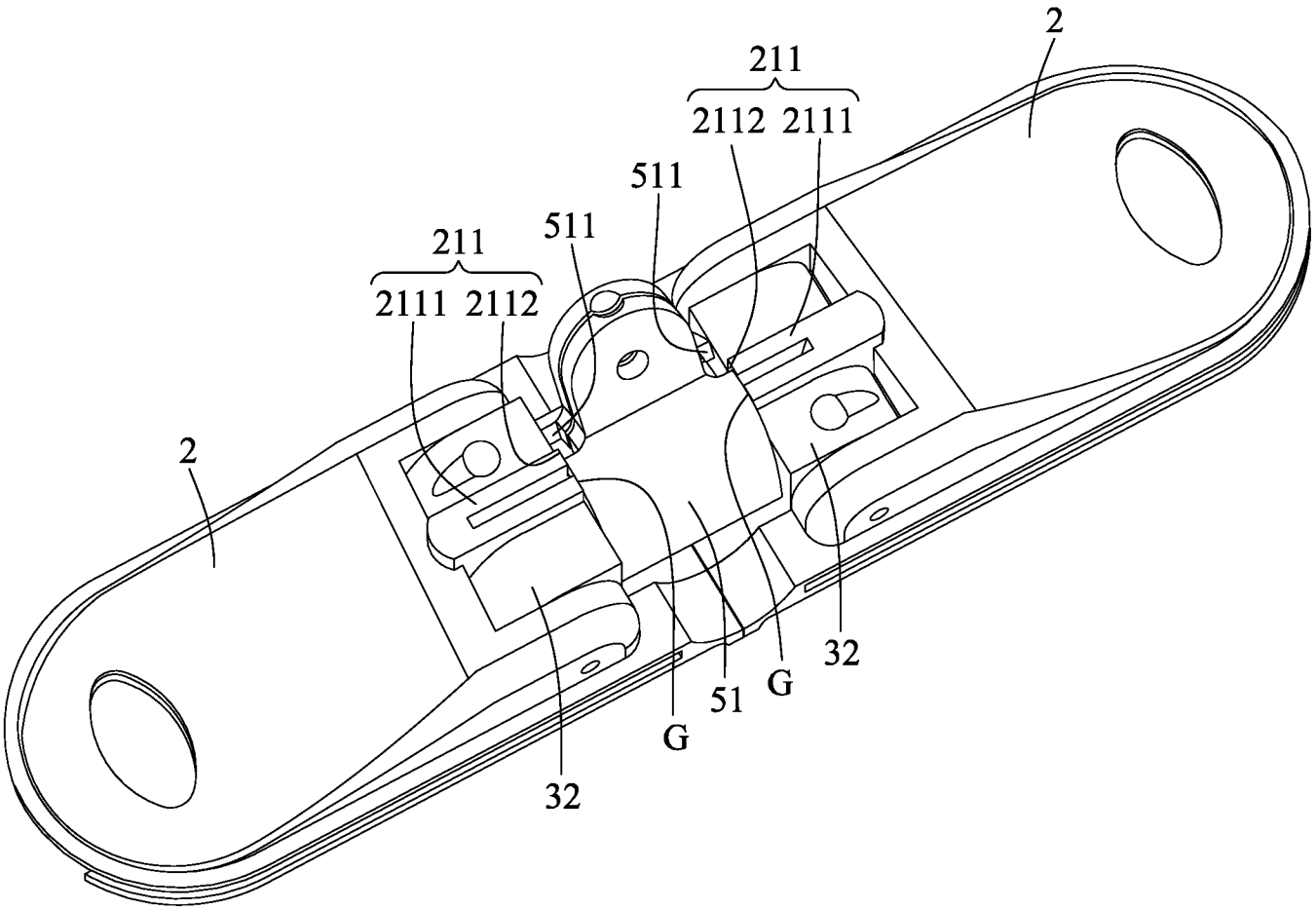
FIG. 5(*a*) shows another perspective view of the synchronously foldable and expandable flat mop shown expanded and locked according to the embodiment of the present invention.
Figure 5B:
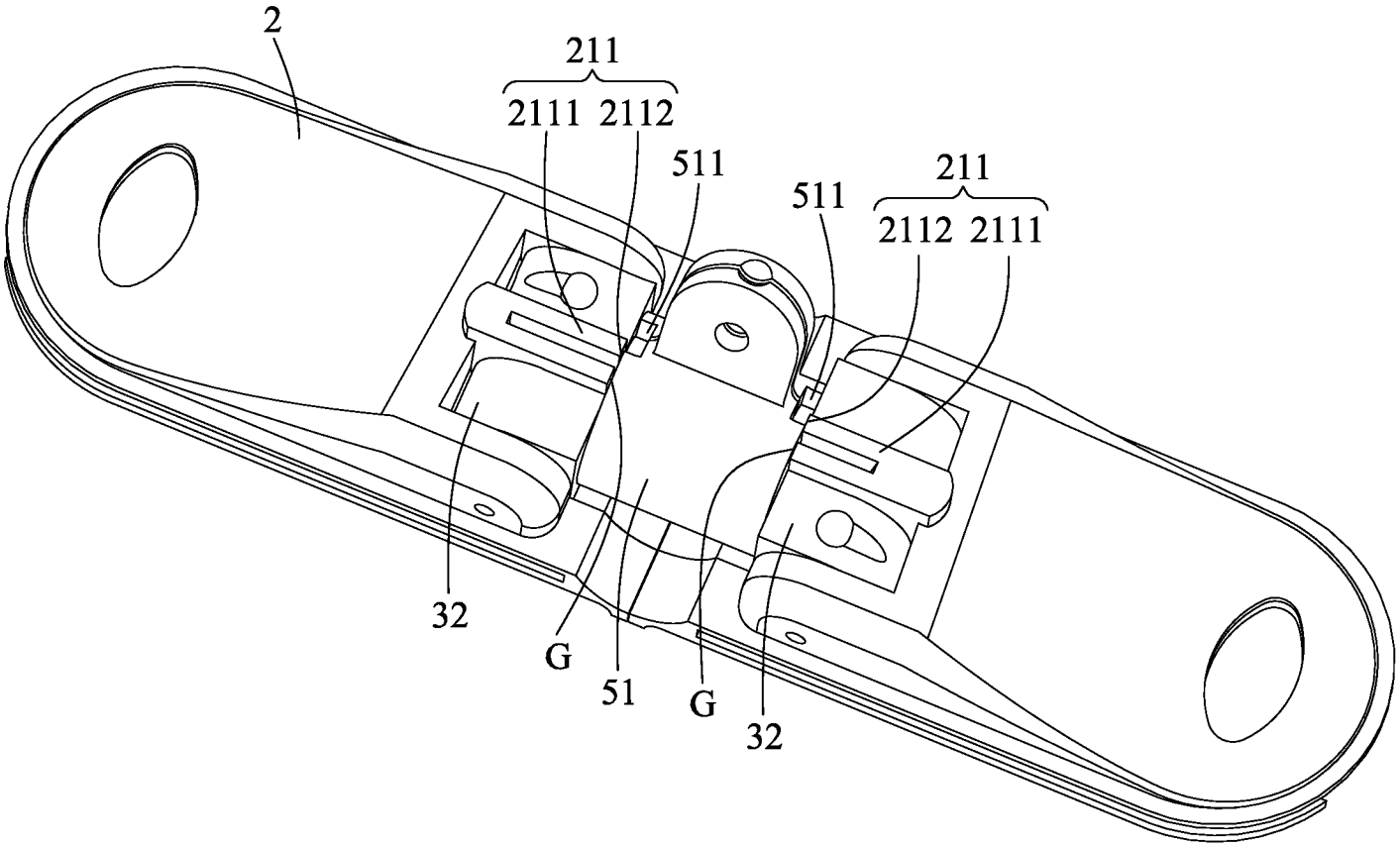

After the two wing plates 2 are operated to expand, the below explains how "the bottom surfaces of the two wing plates 2 are locked in the horizontal plane". With reference to FIGS. 4(*a*) and 4(*b*), when the rotating sleeve connector 5 rotates in relation to the shaft portion 31, the inner surface 513 of the sleeve portion 51 presses against the upper press-against surface 2121 in zone D. As shown in FIG. 4(*c*), the inner surface 513 of the sleeve portion 51 presses against the lower press-against surface 2122 in zone E. The present invention enables both of the upper press-against surface 2121 and the lower press-against surface 2122 to press against the inner surface 513 of the sleeve portion 51 such that the two wing plates 2 are applied with a strong press-against force to fasten the two wing plates 2 with the shaft portion 31 and maintain the two bottom surface of the two wing plates 2 to be in a horizontal plane. Furthermore, FIGS. 5(*a*) and 5(*b*) show a perspective view illustrating that the rotating sleeve connector 5 rotates in relation to the shaft portion 31, in which an outer surface 514 of the sleeve portion 51 presses against the side press-against surface 2112 of the press-against body 21 in the zone G to increase a press-against friction force such that the technical effect of not swaying the mop-holding rod 1 could be achieved.

FIGS. 1(*c*) and 2(*c*) show the two wing plates 2 are operated to fold where the two wing plates 2 are driven by the synchronous-folding-expanding element 4 such that each joint point between the wing plate 2 and the synchronous-folding-expanding connecting body 3 is taken as a rotating axle to enable the two wing plates 2 to synchronous fold with each other. Therefore, the upper protruding portion 211 of the wing plate 2 is fastened in the upper locking recess 511 of the sleeve portion 51 such that the wing plate 2 is firmly locked in the upper locking recess 511. Therefore the sleeve portion 51 cannot rotate in relation to the shaft portion 31.

With reference to FIG. 2(*a*), when the synchronous-folding-expanding element 4 is the gear-engaging component, the gear-engaging component comprises two gear-engaging members 43. The side surface of the press-against body 21 is provided with the gear-corresponding-engaging member 215. The gear-engaging members 43 gear-engages with the gear-corresponding-engaging member 215 such that two wing plates 2 are synchronously expanded and synchronously folded. Meanwhile, the gear-corresponding-engaging member 215 is configured to dispose in the side of the press-against body 21 of the wing plate 2.

FIGS. 1(*a*) and 2(*a*) show that each wing plate 2 comprises two pivot-attaching portions 22. The press-against body 21 is disposed between the two pivot-attaching portions 22. Moreover, the wing-plate-connecting portion 32 comprises two pivot blocks 321. The attaching groove 322 is formed between the two pivot blocks 321. The pivot block 321 is pivotally mounted within pivot-attaching portion 22.

FIGS. 1(*a*) and 2(*a*) show that the receiving accommodations 311 are located outside of two ends of the shaft portion 31. The mop-holding rod 1 pivotally connects to the attaching portion 52. The sleeve portion 51 is provided with a housing hole 515. The attaching portion 52 comprises a slot 521. The shaft portion 31 moves through the slot 521 to be in the housing hole 515 such that the sleeve portion 51 covers the outer circumferential surface of the shaft portion 31. Furthermore, the sleeve portion 51 is provided with a housing hole 515 but not with a slot 521 such that the shaft portion 31 moves through the housing hole 515 to enable the sleeve portion 51 to cover the outer circumferential surface of the shaft portion 31.

Figure 6A:
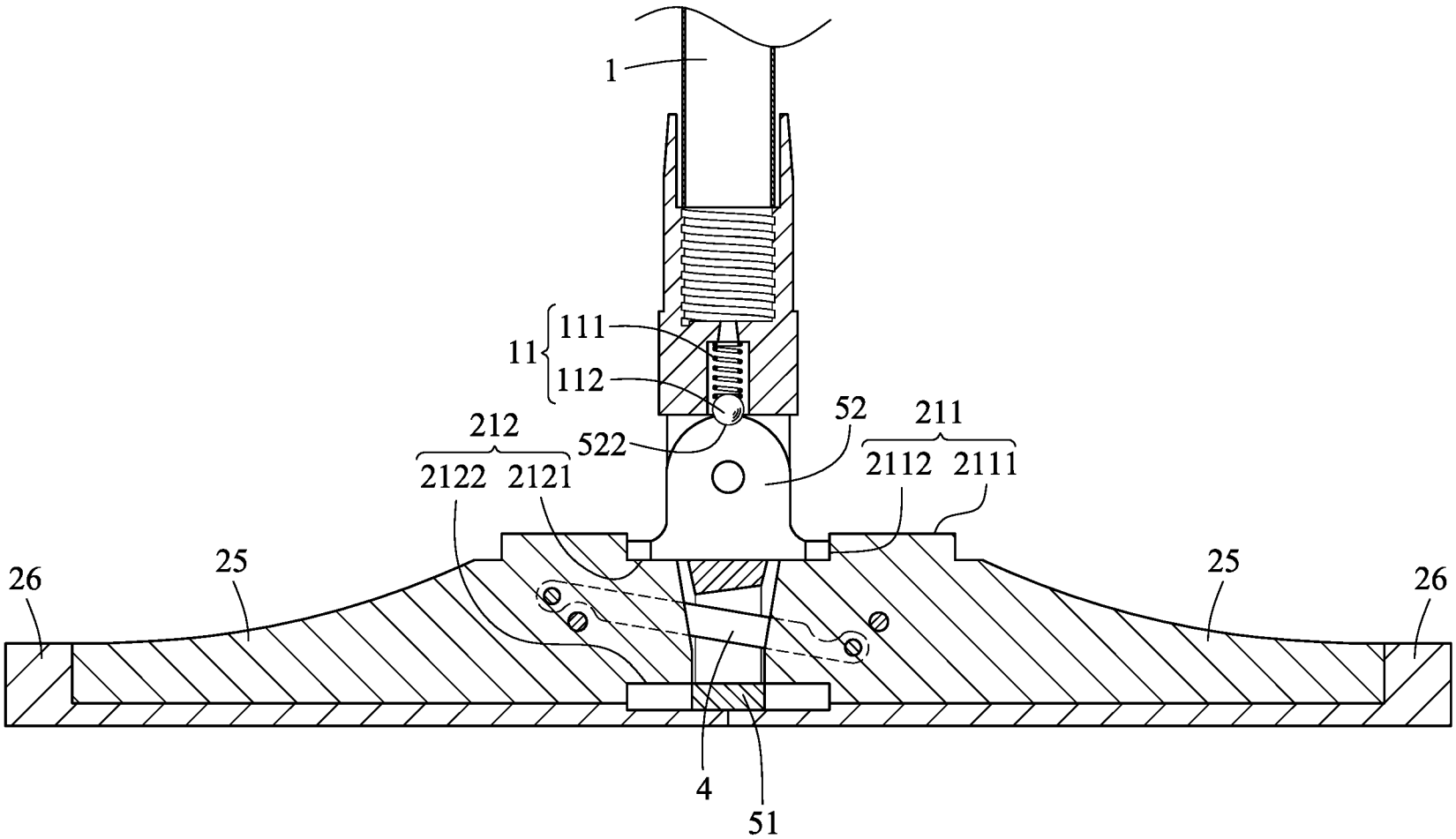
FIG. 6(*a*) shows a cross sectional side view of the synchronously foldable and expandable flat mop according to first embodiment of the present invention.
Figure 6B:
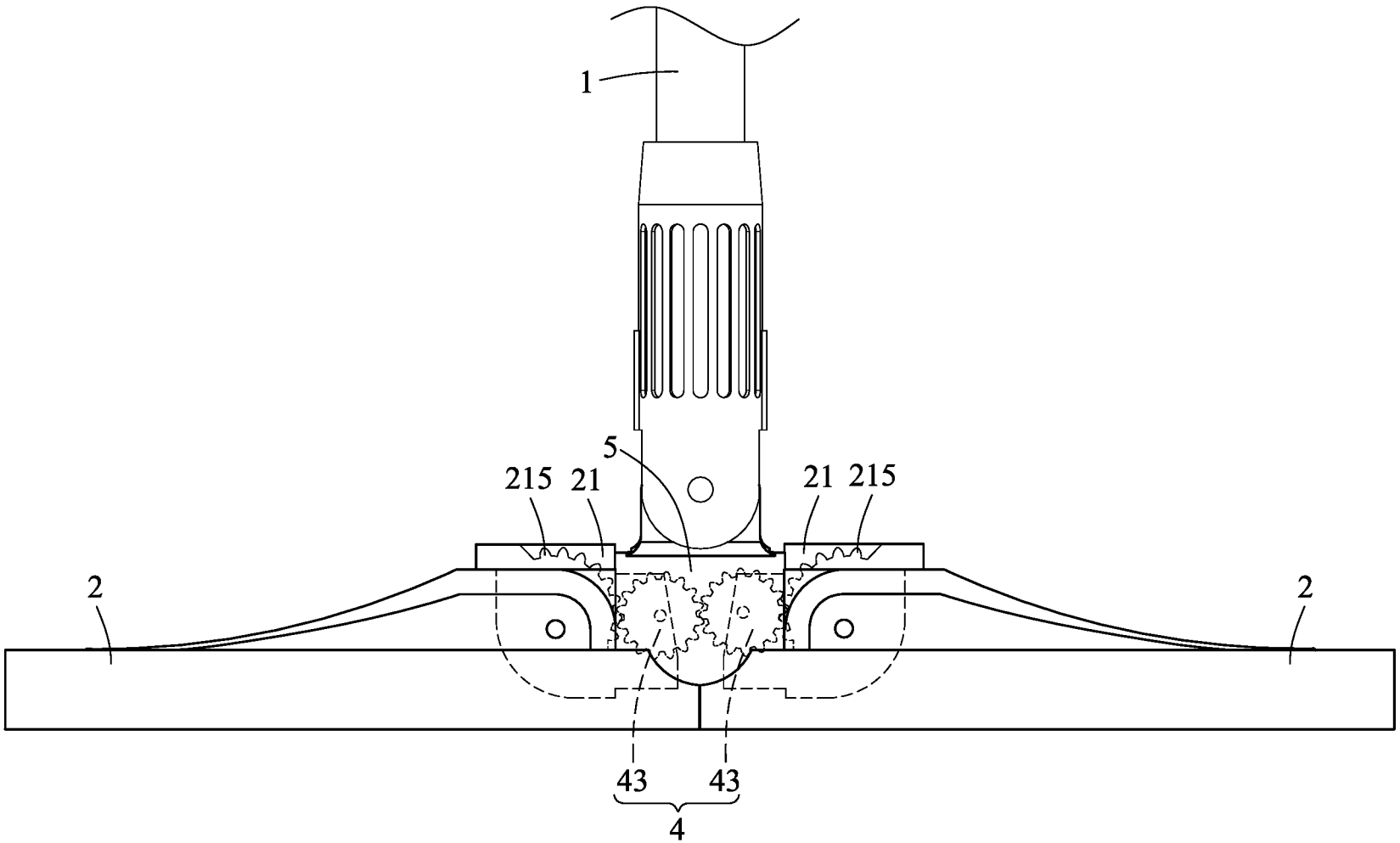
Figure 7A:
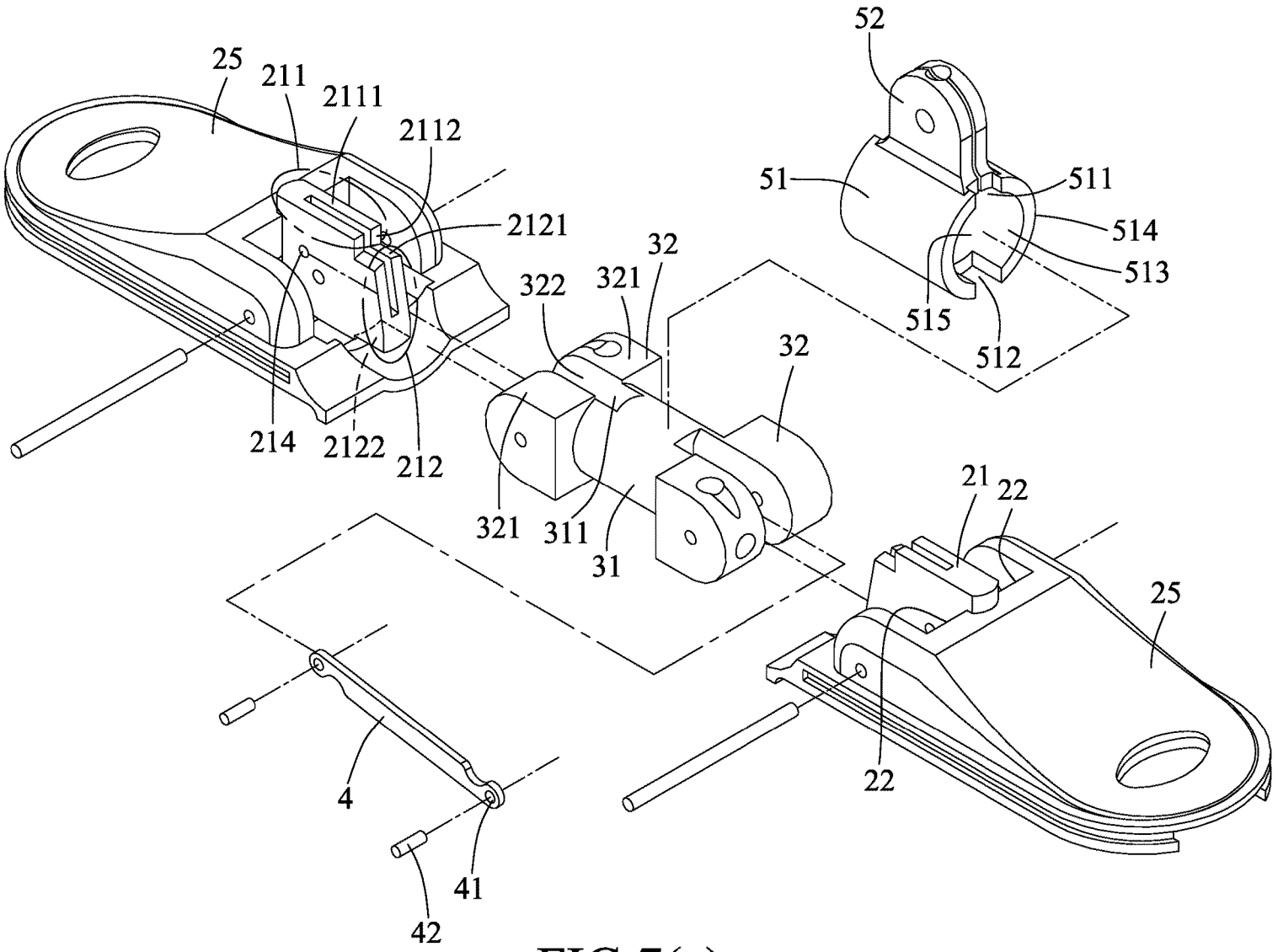
FIG. 7(*a*) shows a partial exploded perspective view of the synchronously foldable and expandable flat mop according to first embodiment of the present invention.
Figure 7B:
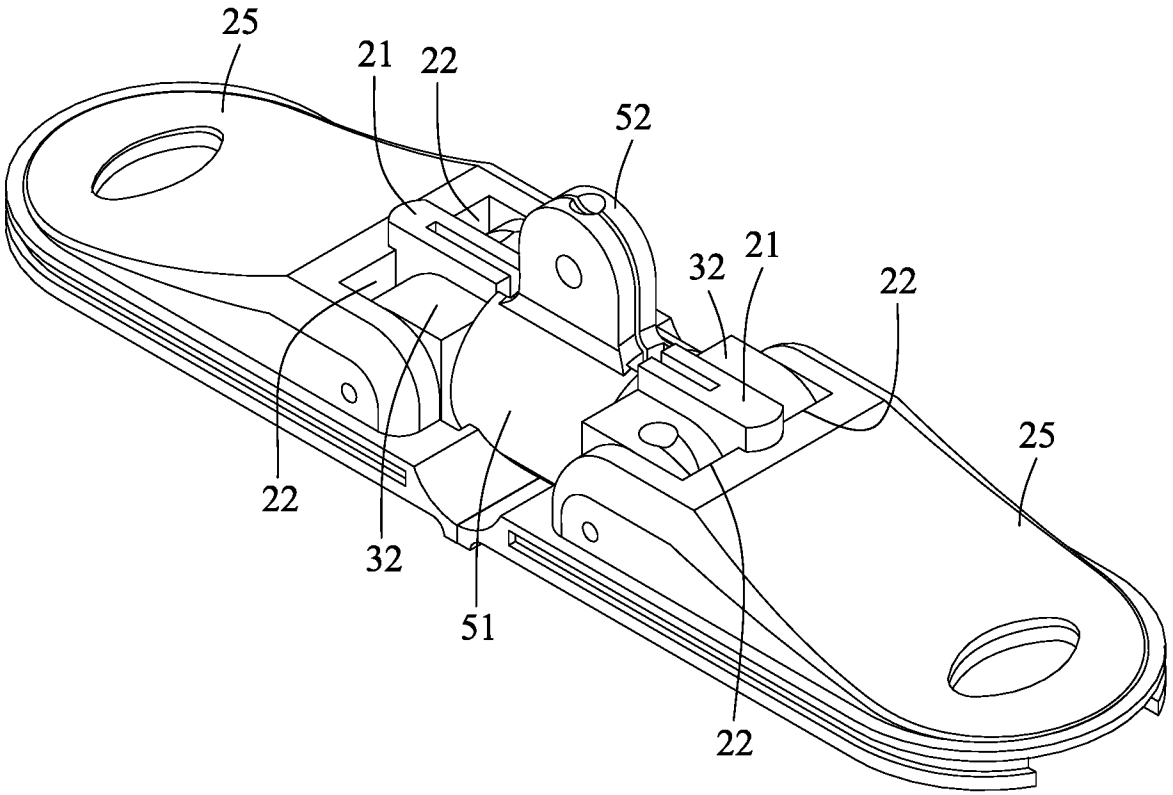
Figure 8A:
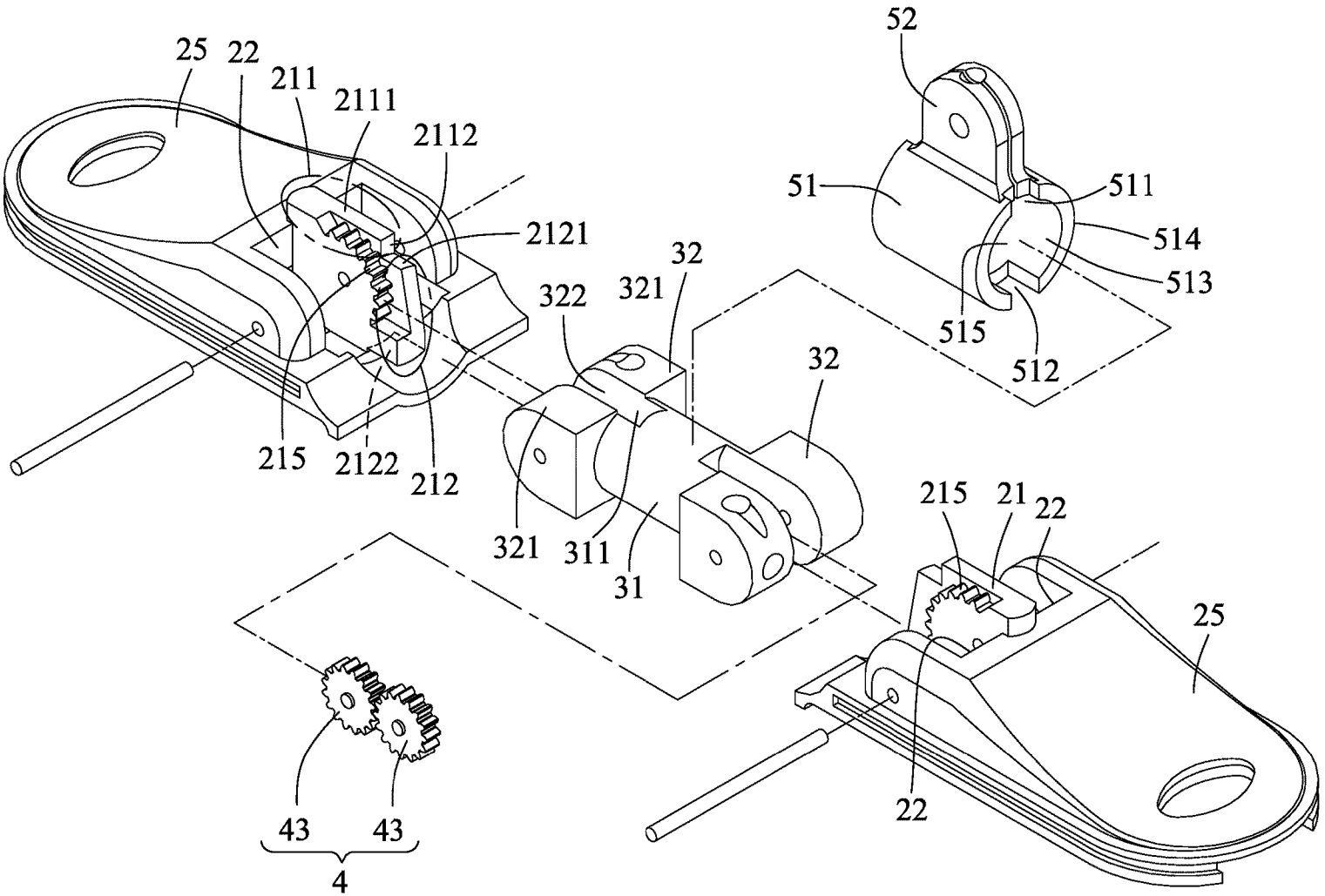
FIG. 8(*a*) shows a partial exploded perspective view of the synchronously foldable and expandable flat mop according to second embodiment of the present invention.
Figure 8B:
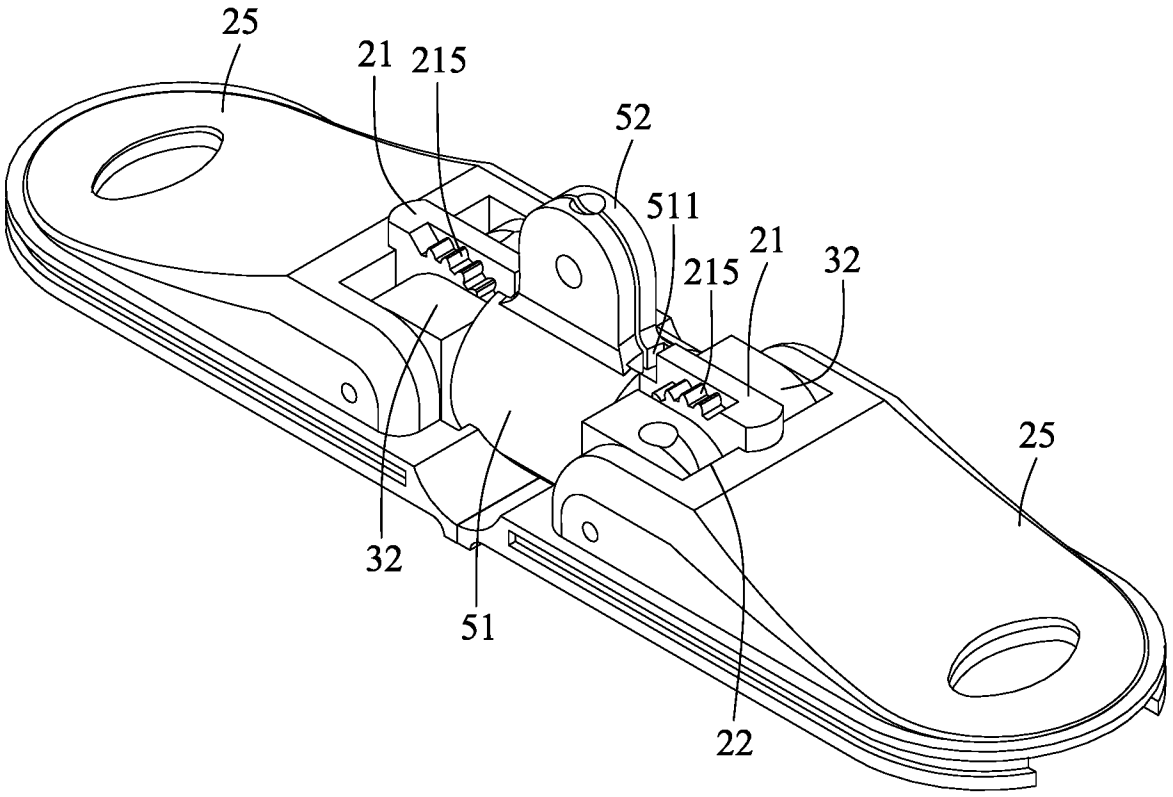

FIGS. 6(*a*), 9(*a*) and 9(*b*) show that the attaching portion 52 of the rotating sleeve connector 5 is provided with a locking portion 522 which presses against a locking corresponding portion 11 disposed at an end of the mop-holding rod 1. The locking corresponding portion 11 includes a spring 111 and a positioning ball 112 such that a spring force from the spring 111 is exerted to the positioning ball 112 to press against the locking portion 522 of the attaching portion 52.

Figure 9A:
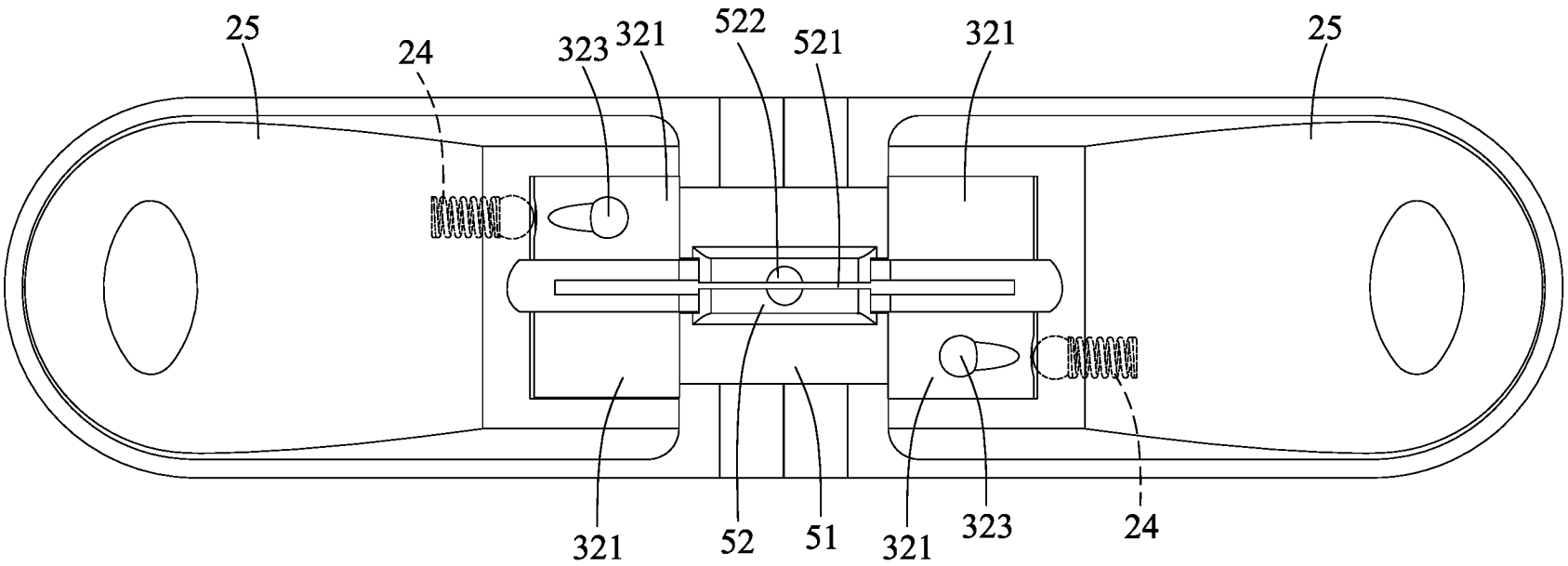
FIG. 9(*a*) shows a top view of the synchronously foldable and expandable flat mop shown the wing plate provided with the wing-plate-positioning set according to the embodiment of the present invention.
Figure 9B:
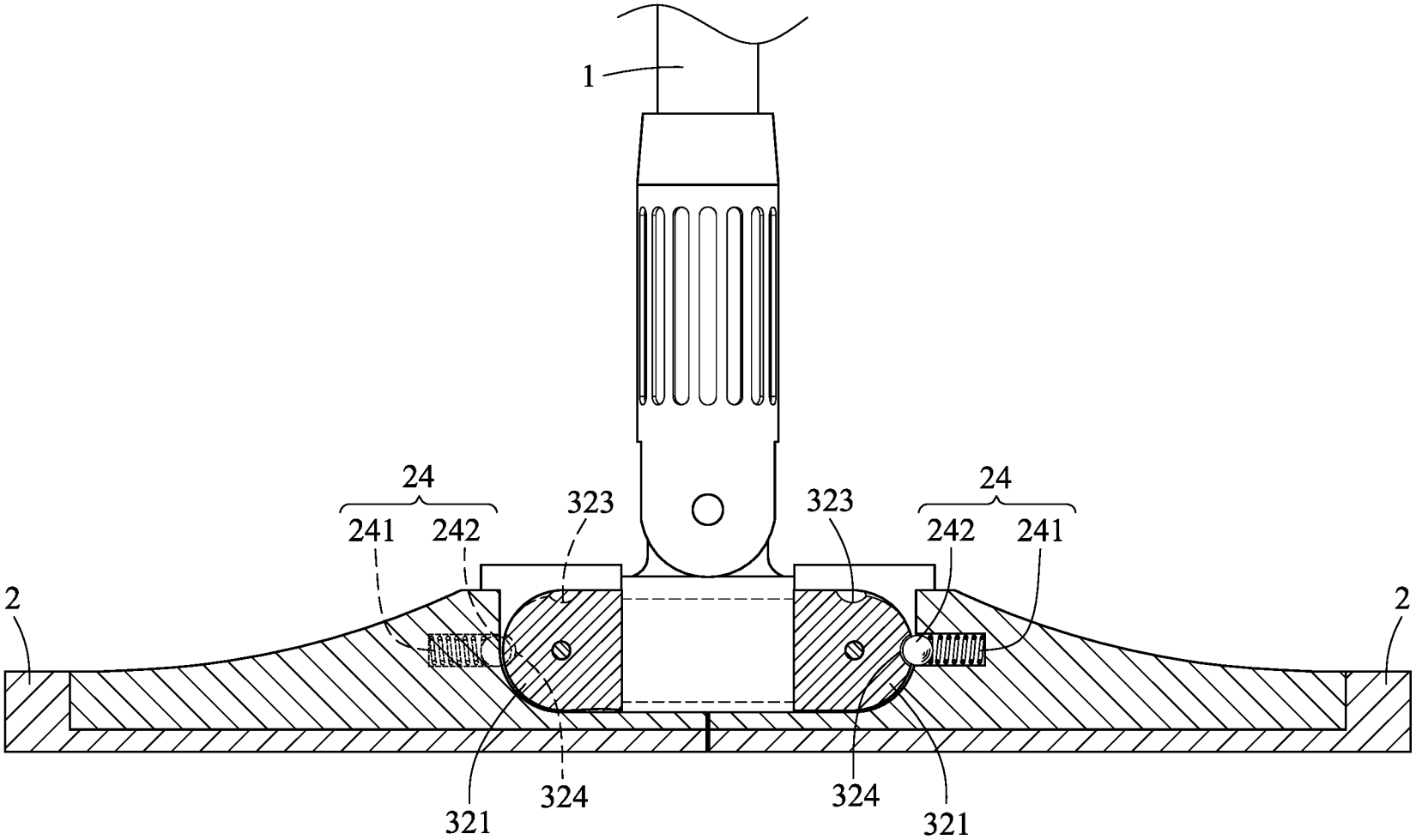

FIGS. 9(*a*) and 9(*b*) show that each wing plate 2 is provided with a wing-plate-positioning set 24 that presses against a fold-positioning portion 323 or an expand-positioning portion 324 of the wing-plate-connecting portion 32 of the synchronous-folding-expanding connecting body 3. When the two wing plates 2 are expanded, the wing-plate-positioning set 24 presses against the expand-positioning portion 324 of the wing-plate-connecting portion 32. When the two wing plates 2 are folded, the wing-plate-positioning set 24 presses against the fold-positioning portion 323 of the wing-plate-connecting portion 32. The wing-plate-positioning set 24 is mounted on a side wall surface of the pivot-attaching portion 22 of the wing plate 2.

FIGS. 9(*a*) and 9(*b*) show that the wing-plate-positioning set 24 is provided with an elastic member 241 and a positioning member 242. The positioning member 242 is disposed on an end of the elastic member 241 and is exposed from the side wall surface of the pivot-attaching portion 22 to press against the fold-positioning portion 323 or the expand-positioning portion 324. The fold-positioning portion 323 and the expand-positioning portion 324 are recesses which are formed in a surface of the wing-plate-connecting portion 32.

FIGS. 1(*a*) and 2(*a*) show that the wing plate 2 includes a plate base 25 and a plate body 26. A bottom surface of the plate base 25 is provided with a slide-connecting portion 251. The cleaning member W is mounted on a bottom side of the plate body. Moreover, the plate body 26 is provided with a slide-engaging portion 261 which corresponds to the slide-connecting portion 251. The slide-engaging portion 261 slidably connects to or slidably removes from the slide-connecting portion 251 of the plate base 25 in a longitudinal direction of the plate base 25 such that the plate body 26 can be replaced by user as a replacement of the plate body 26 is required.

The above embodiment is merely the explanation of the present invention. The ordinary person skilled in the art can apply other adjustments according to the claims below and the above embodiment. However, the adjustments still belong to the technical concept of the present invention and fall into the claims of the present invention.

What is claimed is:

1. A synchronously foldable and expandable flat mop, comprising:

a mop-holding rod;

two wing plates, each wing plate having a press-against body, the press-against body being provided with an upper protruding portion and a side protruding portion, the upper protruding portion being provided with a top surface and a side press-against surface, the side protruding portion being provided with an upper press-against surface and/or a lower press-against surface, a height of the top surface is higher than a height of the upper press-against surface, and a cleaning member being provided on a bottom surface of each wing plate;

a synchronous-folding-expanding connecting body having a shaft portion and two wing-plate-connecting portions, a receiving accommodation being provided in each end of the shaft portion, each wing-plate-connecting portion being extended from each end of the two ends of the shaft portion such that each wing-plate-connecting portion is pivotally connected to each wing plate;

a synchronous-folding-expanding element being installed in a hole of the shaft portion, each end of the synchronous-folding-expanding element being pivotally connected to or being gear engaged with each one of two wing plates such that the two wing plates are synchronously to be folded or expanded in relation to the synchronous-folding-expanding element; and a rotating sleeve connector including a sleeve portion and an attaching portion, each end of two ends of the sleeve portion being provided with an upper locking recess and a lower locking recess, the sleeve portion being provided to cover an outer circumferential surface of the shaft portion of the synchronous-folding-expanding connecting body to rotate in relation to the shaft portion, the attaching portion protrudes upward from the sleeve portion to connect to the mop-holding rod, wherein when the two wing plates are to be folded, the two wing plates are synchronously driven by the synchronous-folding-expanding element such that the two wing plates are synchronous to be folded with each other by taking each joint point between the wing plate and the synchronous-folding-expanding connecting body as a rotating axle to thus enable the upper protruding portion of the wing plate to fasten in the upper locking recess of the sleeve portion to firmly lock the wing plate to the upper locking recess, wherein when the two wing plates are to be expanded, the two wing plates are synchronously driven by the synchronous-folding-expanding element such that the two wing plates are synchronous expanded with each other by taking each joint point between the wing plate and the synchronous-folding-expanding connecting body as a rotating axle to enable the side protruding portion of the wing plate to pass through the lower locking recess of the sleeve portion until the side protruding portion is accommodated within the receiving accommodation, and then the rotating sleeve connector is rotated with respective to the shaft portion to enable the upper press-against surface and/or the lower press-against surface to press against a press-against area of an inner surface of the sleeve portion.

2. The synchronously foldable and expandable flat mop as claimed in claim 1, wherein when the upper press-against surface of the side protruding portion and/or the lower press-against surface of the side protruding portion is moved to the press-against area, and the rotating sleeve connector rotates with respective to the shaft portion, an outer surface of the sleeve portion presses against the side press-against surface of the upper protruding portion.

3. The synchronously foldable and expandable flat mop as claimed in claim 1, wherein when the synchronous-folding-expanding element is pivotally connected with the two wing plates, the synchronous-folding-expanding element is a crossbar.

4. The synchronously foldable and expandable flat mop as claimed in claim 1, wherein when the synchronous-folding-expanding element is engaged with the two wing plates by gear, the synchronous-folding-expanding element is two gear-engaging members which are gear-engaged with each other, and a surface of each wing plate is provided with a gear-corresponding-engaging member.

5. The synchronously foldable and expandable flat mop as claimed in claim 1, wherein each wing plate is provided with two pivot-attaching portions between which the press-against body is formed, and the wing-plate-connecting portion is provided with two pivot blocks between which an attaching groove is formed such that each pivot block is pivotally mounted within the pivot-attaching portion of each wing plate.

6. The synchronously foldable and expandable flat mop as claimed in claim 5, wherein each wing plate is provided with a wing-plate-positioning set which is mounted on a side wall surface of the pivot-attaching portion of the wing plate, the wing-plate-positioning set presses against a fold-positioning portion of the wing-plate-connecting portion of the synchronous-folding-expanding connecting body or an expand-positioning portion of the wing-plate-connecting portion of the synchronous-folding-expanding connecting body such that when the two wing plates are synchronously expanded, the wing-plate-positioning set presses against the expand-positioning portion of the wing-plate-connecting portion, and when the two wing plates are synchronously to be folded, the wing-plate-positioning set presses against the fold-positioning portion of the wing-plate-connecting portion.

7. The synchronously foldable and expandable flat mop as claimed in claim 6, wherein the wing-plate-positioning set is provided with an elastic member and a positioning member, the positioning member is disposed on an end of the elastic member and is exposed from the side wall surface of the pivot-attaching portion to press against the fold-positioning portion or the expand-positioning portion, wherein the fold-positioning portion and the expand-positioning portion are recesses which are formed in a surface of the wing-plate-connecting portion.

8. The synchronously foldable and expandable flat mop as claimed in claim 1, wherein the receiving accommodations are located outside of two ends of the shaft portion.

9. The synchronously foldable and expandable flat mop as claimed in claim 1, wherein the mop-holding rod pivotally connects to the attaching portion.

10. The synchronously foldable and expandable flat mop as claimed in claim 1, wherein the sleeve portion is provided with a housing hole and a slot such that the shaft portion moves through the slot to be in the housing hole such that the sleeve portion covers the outer circumferential surface of the shaft portion.

11. The synchronously foldable and expandable flat mop as claimed in claim 1, wherein the sleeve portion is provided with a housing hole but not with a slot such that the shaft portion moves through the housing hole to enable the sleeve portion to cover the outer circumferential surface of the shaft portion.

12. The synchronously foldable and expandable flat mop as claimed in claim 1, wherein the attaching portion of the rotating sleeve connector is provided with a locking portion which presses against a locking corresponding portion disposed at an end of the mop-holding rod, the locking corresponding portion includes a spring and a positioning ball such that a spring force from the spring is exerted to the positioning ball to press against the locking portion of the attaching portion.

13. The synchronously foldable and expandable flat mop as claimed in claim 1, wherein the wing plate includes a plate base and a plate body, a bottom surface of the plate base is provided with a slide-connecting portion, the cleaning member is mounted on a bottom side of the plate body, and the plate body is provided with a slide-engaging portion which corresponds to the slide-connecting portion, the slide-engaging portion slidably connects to or slidably removes from the slide-connecting portion of the plate base in a longitudinal direction of the plate base.

* * * * *